US009167849B2

(12) United States Patent
Adamic

(10) Patent No.: US 9,167,849 B2
(45) Date of Patent: Oct. 27, 2015

(54) SMOKE AND ODOR ELIMINATION FILTERS, DEVICES AND METHODS

(76) Inventor: Kelly J. Adamic, Alamo, CA (US)

( * ) Notice: Subject to any disclaimer, the term of this patent is extended or adjusted under 35 U.S.C. 154(b) by 427 days.

(21) Appl. No.: 13/092,899

(22) Filed: Apr. 22, 2011

(65) Prior Publication Data

US 2011/0240047 A1 Oct. 6, 2011

Related U.S. Application Data

(63) Continuation-in-part of application No. 12/871,500, filed on Aug. 30, 2010, now abandoned.

(60) Provisional application No. 61/327,064, filed on Apr. 22, 2010, provisional application No. 61/428,204, filed on Dec. 29, 2010, provisional application No. 61/238,091, filed on Aug. 28, 2009, provisional application No. 61/242,229, filed on Sep. 14, 2009.

(51) Int. Cl.

| | |
|---|---|
| ***A24F 11/00*** | (2006.01) |
| ***A24F 1/00*** | (2006.01) |
| ***A24F 3/00*** | (2006.01) |
| ***A24F 13/00*** | (2006.01) |
| ***A24F 13/06*** | (2006.01) |

(52) U.S. Cl.
CPC ... *A24F 1/00* (2013.01); *A24F 3/00* (2013.01); *A24F 13/00* (2013.01); *A24F 13/06* (2013.01)

(58) Field of Classification Search
None
See application file for complete search history.

(56) References Cited

U.S. PATENT DOCUMENTS

| | | | | |
|---|---|---|---|---|
| 3,348,553 A | | 10/1967 | Huber | |
| 4,369,798 A | | 1/1983 | Jackson | |
| 4,570,646 A | | 2/1986 | Herron | |
| 4,790,332 A | | 12/1988 | Wallace | |
| 4,993,435 A | | 2/1991 | McCann | |
| 5,160,518 A | * | 11/1992 | Vega, Jr. | 55/385.8 |
| 5,178,165 A | | 1/1993 | DeFelice | |
| D346,878 S | | 5/1994 | Gee et al. | |
| D347,490 S | | 5/1994 | Gee et al. | |
| 5,388,595 A | | 2/1995 | Shafer | |
| D364,480 S | | 11/1995 | Warren, Sr. | |
| 5,497,791 A | | 3/1996 | Bowen et al. | |
| D368,552 S | | 4/1996 | Adams | |
| 5,848,596 A | | 12/1998 | Zelenik | |
| 5,878,752 A | | 3/1999 | Adams et al. | |
| D411,332 S | | 6/1999 | Zelenik | |
| 5,967,148 A | | 10/1999 | Harris et al. | |
| D422,113 S | | 3/2000 | Higgins et al. | |

(Continued)

FOREIGN PATENT DOCUMENTS

WO WO 0158290 A1 * 8/2001

OTHER PUBLICATIONS

Search Report and Written Opinion mailed Oct. 21, 2010 from International Serial No. PCT/US2010/047109, filed Aug. 30, 2010.

(Continued)

*Primary Examiner* — Richard Crispino
*Assistant Examiner* — Phu Nguyen
(74) *Attorney, Agent, or Firm* — Sheppard, Mullin, Richter & Hampton LLP

(57) ABSTRACT

A pipe comprises a combustion chamber with vents, the combustion chamber able to receive a cigarette; an inhalation path for drawing smoke from the combustion chamber through the bowl vents during inhalation; an exhalation filter; and an exhalation path for channeling exhaled smoke through the exhalation filter during exhalation.

6 Claims, 32 Drawing Sheets

(56) References Cited

U.S. PATENT DOCUMENTS

| | | | | |
|---|---|---|---|---|
| D424,236 | S | 5/2000 | Reed | |
| 6,089,857 | A | 7/2000 | Matsuura et al. | |
| 6,158,530 | A * | 12/2000 | Bowen et al. | 131/175 |
| D483,148 | S | 12/2003 | Merideth | |
| D485,639 | S | 1/2004 | Stronski | |
| 6,814,083 | B2 | 11/2004 | Likness et al. | |
| D577,150 | S | 9/2008 | Bryman et al. | |
| D588,741 | S | 3/2009 | Murdaugh et al. | |
| 7,513,258 | B2 | 4/2009 | Kollasch et al. | |
| 7,694,685 | B1 | 4/2010 | Jones | |
| D634,891 | S | 3/2011 | Han | |
| 7,905,236 | B2 | 3/2011 | Bryman et al. | |
| D647,247 | S | 10/2011 | Jones | |
| D649,708 | S | 11/2011 | Oneil | |
| 2002/0005207 | A1 | 1/2002 | Wrenn et al. | |
| 2004/0187879 | A1 | 9/2004 | Iordan | |
| 2006/0272659 | A1 | 12/2006 | Kobal et al. | |
| 2007/0204868 | A1 * | 9/2007 | Bollinger et al. | 131/174 |
| 2007/0283971 | A1 | 12/2007 | Gidding | |
| 2009/0173355 | A1 | 7/2009 | Johnson | |
| 2011/0073120 | A1 | 3/2011 | Adamic | |

OTHER PUBLICATIONS

Search Report and Written Opinion mailed Jul. 12, 2011 from International Serial No. PCT/US2011/033692, filed Apr. 22, 2011.

Design U.S. Appl. No. 29/373,355, filed Mar. 31, 2011, Adamic, Kelly J.

Design U.S. Appl. No. 29/373,370, filed Mar. 31, 2011, Adamic, Kelly J.

Design U.S. Appl. No. 29/373,373, filed Mar. 31, 2011, Adamic, Kelly J.

Office Action mailed Dec. 22, 2011 from U.S. Appl. No. 12/871,500, filed Aug. 30, 2010.

* cited by examiner

B-B INTAKE CAVITY
SCALE 1.1

C-C FILTER CAVITY
SCALE 1:1

FILTER CAVITY SECTION R-R

LIGHTER/BOWL CAVITY A-A

SECTION H-H

SECTION C-C

2100
INTAKE FLUID
2110
2220
2402
2404
2408
2320
2336
2412
2310
2313
2406
2105
EXHAUST FLUID
2306
SECTION B-B

SHUTTER
2320
2408
2336
2406
SHUTTER
DETAIL

B
2105
2215
B

F-F CIGARETTE CAVITY

C-C FILTER CAVITY

SMOKE AND ODOR ELIMINATION FILTERS, DEVICES AND METHODS

PRIORITY CLAIM

This application claims priority to and incorporates by reference provisional patent application Ser. No. 61/327,064, entitled "Smoke and Odor Elimination Filter and Devices," filed on Apr. 22, 2010, by inventor Kelly Adamic, and claims priority to provisional patent application Ser. No. 61/428,204, entitled "Smoke and Odor Elimination Filters, Devices, and Methods for Cigarettes," filed on Dec. 29, 2010, by inventor Kelly Adamic. This application is a continuation-in-part of and incorporates by reference non-provisional patent application Ser. No. 12/871,500, entitled "Smoke and Odor Elimination Filters, Devices and Methods," filed on Aug. 30, 2010 now abandoned, by inventor Kelly Adamic, which claims benefit of and incorporates by reference the following provisional patent applications: provisional patent application serial number 61/238,091, entitled "Enclosed Smoking Device," filed on Aug. 28, 2009, by inventor Kelly Adamic; provisional patent application Ser. No. 61/242,229, entitled "Enclosed Smoking Device with Timed Ignition Button," filed on Sep. 14, 2009, by inventor Kelly Adamic; and provisional patent application Ser. No. 61/327,064, entitled "Smoke and Odor Elimination Filter and Devices," filed on Apr. 22, 2010, by inventor Kelly Adamic.

COPYRIGHT NOTICE

A portion of the disclosure of this patent document contains material which is subject to copyright protection. The copyright owner has no objection to the facsimile reproduction by anyone of the patent document or the patent discloser, as it appears in the Patent and Trademark Office patent file or records, but otherwise reserves all copyrights whatsoever.

TECHNICAL FIELD

This invention relates generally to smoking devices, and more particularly relates to smoke and odor elimination filters, devices and methods.

BACKGROUND

Smoking is a practice in which a combustible substance, e.g., tobacco, cannabis, or herbs, is burned and the resulting smoke inhaled. Combustion of the substance causes the release of active drugs such as nicotine or THC and makes them available for a smoker to absorb through the lungs. The most common way of smoking today is through cigarettes, primarily industrially manufactured but also hand-rolled using rolling paper. Other smoking tools include traditional pipes, cigars, hookahs and water-pipes, or bongs.

People smoke for recreation, as a part of rituals, in search of a spiritual enlightenment, and for medical purposes. The history of smoking can be dated to as early as 5000 BC, and has been recorded in many different cultures around the world. Early smoking evolved in association with religious ceremonies, as offerings to deities, in cleansing rituals, or as a process of divination. The practice of smoking has become commonplace.

It will be appreciated that, while cannabis for recreational use is illegal in many parts of the world, its use as a medicine is legal in a number of territories, including Canada, Austria, Germany, the Netherlands, Spain, Israel, Italy, Finland, and Portugal. In the United States, permission for medical cannabis varies from state to state, several having enacted laws to allow regulated cannabis consumption, possession, cultivation, and distribution for medicinal use.

Though smoking is commonplace and enjoyable, inhalation of smoke may adversely affect the health of a smoker. Carcinogens in tobacco or cannabis smoke may increase a smoker's risk of developing cardiovascular disease, pulmonary disease, cancer, and other diseases. Many industrially manufactured cigarettes employ a filter to reduce the amount of nicotine, tetrahydrocannabinol (THC), tar, smoke, and particulate matter that a smoker inhales when a cigarette is burned. Industrially manufactured filters may comprise various materials and may have a predetermined length, such as approximately thirty percent of a cigarette's length. However, cigarette filters do not limit the protect non-smokers or others who are located near a smoker.

As a result, smoking may adversely affect the health of non-smokers, including a smoker's non-smoking friends and family members. When non-smokers are exposed to secondhand smoke, it is commonly referred to as passive smoking. Non-smokers who breathe in secondhand smoke take in the nicotine, THC, tar, smoke, particulate matter, and/or other chemicals just like smokers do. Passive smoking has played a central role in the debate over the harms and regulation of tobacco products. Since the early 1970s, the tobacco industry has been concerned about passive smoking as a serious threat to its business interests. Passive smoking was perceived as motivation for stricter regulation of tobacco products as well as for smoking bans in workplaces and indoor public establishments, such as restaurants, bars, and nightclubs.

Even those who are not located near a smoker may still suffer from the adverse effects of smoking later on. Smoking releases odors that get into hair, clothing, and other surfaces, even after the smoke is no longer visible. Some researchers call this remnant odor "thirdhand" smoke. Essentially, the particles caused by smoking settle on surfaces and can be measured long after a person has finished smoking.

What is desired are mechanisms for preserving the commonplace and enjoyable experience of smoking, while reducing or eliminating the adverse effects of secondhand and thirdhand smoke.

SUMMARY

In accordance with some embodiments, the present invention provides a pipe, comprising a combustion chamber with vents, the combustion chamber capable of receiving a cigarette; an inhalation path configured to draw smoke from the combustion chamber through the vents during inhalation; an exhalation path configured to channel exhaled smoke through an exhalation filter during exhalation; and a mouthpiece coupled to the inhalation path and the exhalation path.

The inhalation path may include a one-way inhalation valve between the combustion chamber and the mouthpiece. The pipe may further comprise a lid over the combustion chamber, the lid creating a substantially airtight inhalation seal with the combustion chamber. The lid of the pipe may comprise a lighting port operative to allow a heat source to access the combustion chamber. The mouthpiece of the pipe may comprise an aperture configured to receive the cigarette. In some embodiments, the pipe may comprise a shutter configured to substantially limit airflow to the inhalation path when the cigarette reaches a predetermined length. In some embodiments, the pipe may comprise a sliding contact block configured to substantially limit airflow to the inhalation path when the cigarette reaches a predetermined length, such as the length of its filter.

The one-way exhalation valve may be part of the exhalation filter. The exhalation filter may include an exhalation filter cartridge. The pipe may further comprise an internal lighter for providing a flame to the combustion chamber. The pipe may further comprise a timed ignition switch for controlling the length of time that a flame is delivered to the combustion chamber. The exhalation filter may include a housing, a high efficiency particulate air (HEPA) filter, and a foam core. The foam core may include a central bore extending the length of the foam core, and the foam core includes odor absorbing chemicals for removing the odor from the exhaled smoke.

In accordance with some embodiments, the present invention provides a method, comprising: burning a cigarette in a combustion chamber having vents, the cigarette creating smoke; channeling at least portions of the smoke from the combustion chamber through the vents to a smoker, the at least portions of the smoke passing through a mouthpiece; receiving exhaled smoke from the smoker, the exhaled smoke passing through the mouthpiece; channeling the exhaled smoke to an exhalation filter; and filtering the exhaled smoke by the exhalation filter.

The smoke from the combustion chamber may be channeled to the smoker via a mouthpiece and the exhaled smoke may be received through the same mouthpiece. The method may further comprise preventing the exhaled smoke from being delivered to the combustion chamber. The method may further comprise preventing the smoke from the combustion chamber from including air from the exhalation filter. The method may further comprise controlling the length of time that a flame is delivered to the cigarette in the combustion chamber. The exhalation filter may include a housing, a HEPA filter, and a foam core. The foam core may include a central bore extending the length of the foam core, and the foam core may include odor absorbing chemicals for removing the odor from the exhaled smoke.

In accordance with some embodiments, the present invention includes a pipe comprising: a combustion chamber with vents, the combustion chamber comprising means for holding a cigarette; means for drawing smoke from the combustion chamber through the vents during inhalation; means for channeling at least a portion of the smoke to a smoker; means for receiving exhaled smoke from the smoker; and means for channeling the exhaled smoke through an exhalation filter during exhalation.

BRIEF DESCRIPTION OF THE DRAWINGS

FIGS. 25*a*-26*c* illustrate the internal details of an exhalation filter, in accordance with an embodiment of the present invention.

FIGS. 26*a*-26*c* present different views of a smoke and odor elimination cigarette-smoking pipe, in accordance with an embodiment of the present invention.

DETAILED DESCRIPTION

The following description is provided to enable any person skilled in the art to make and use the invention. Various modifications to the embodiments are possible, and the generic principles defined herein may be applied to these and other embodiments and applications without departing from the spirit and scope of the invention. Thus, the invention is not intended to be limited to the embodiments and applications shown, but is to be accorded the widest scope consistent with the principles, features, and teachings disclosed herein.

Figure 1C:
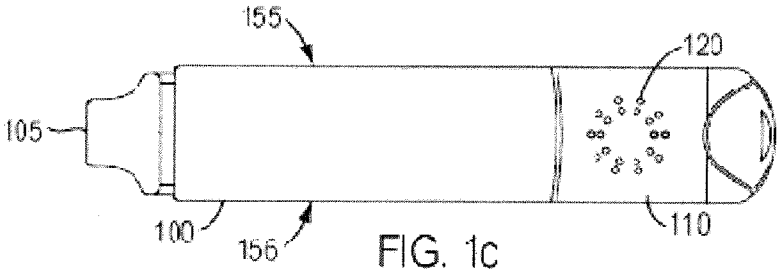
FIGS. 1*a*-1*e* illustrate a smoke and odor elimination smoking pipe, in accordance with an embodiment.
Figure 1B:
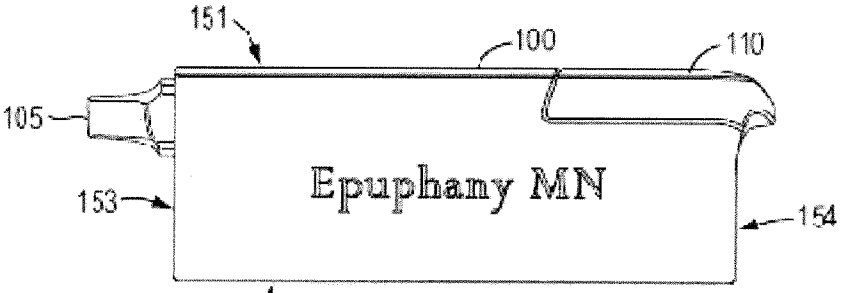
Figure 1D:
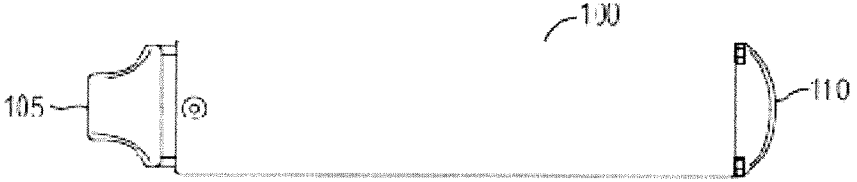
Figure 1A:
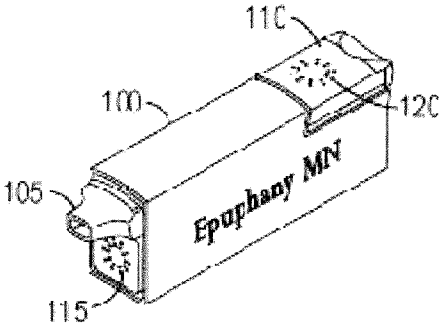
Figure 1E:
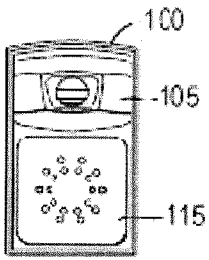

FIGS. 1*a*-1*e* illustrate a smoke and odor elimination pipe 100, in accordance with an embodiment of the present invention. FIG. 1*a* is a perspective view of the pipe 100. FIG. 1*b* is a side view of the pipe 100. FIG. 1*c* is a top view of the pipe 100. FIG. 1*d* is a bottom view of the pipe 100. FIG. 1*e* is a front view of the pipe 100.

As shown in FIGS. 1*a*-1*e*, the pipe 100 has six sides, namely, a top side 151, a bottom side 152, a front side 153, a rear side 154, a left side 155, and a right side 156. The pipe 100 includes a mouthpiece 105 and one-way exhalation vents 115 on the front side 153, and a flip-top lid 110 with one-way inhalation vents 120 on the top side 151.

In use, the smoker opens the lid 110, exposing a combustion bowl (not shown) with combustible substance therein. The smoker applies a flame over the combustible substance, e.g., using a butane lighter, and inhales through the mouthpiece 105. Airflow causes the combustible substance to burn and smoke to pass through an inhalation path in the pipe 100 via an inhalation filter (not shown) and out the mouthpiece 105 to the smoker. The smoker closes the lid 110, which effectively prevents air from flowing out the opening exposed when the lid 110 is open. Air can still be drawn through the one-way inhalation vents 120. The smoker then exhales through the same mouthpiece 105. The smoke passes through an exhalation path in the pipe 100 through an exhalation filter (not shown) and out the exhalation vents 115. The exhalation filter scrubs the smoke and odor particles.

In one embodiment, the pipe 100 is about 4 inches long (front to rear), 1.5 inches tall (top to bottom), and ⅞ inch wide (left to right). Components of the pipe 100 may be made of a metal such as aluminum or of plastic.

Figure 2:
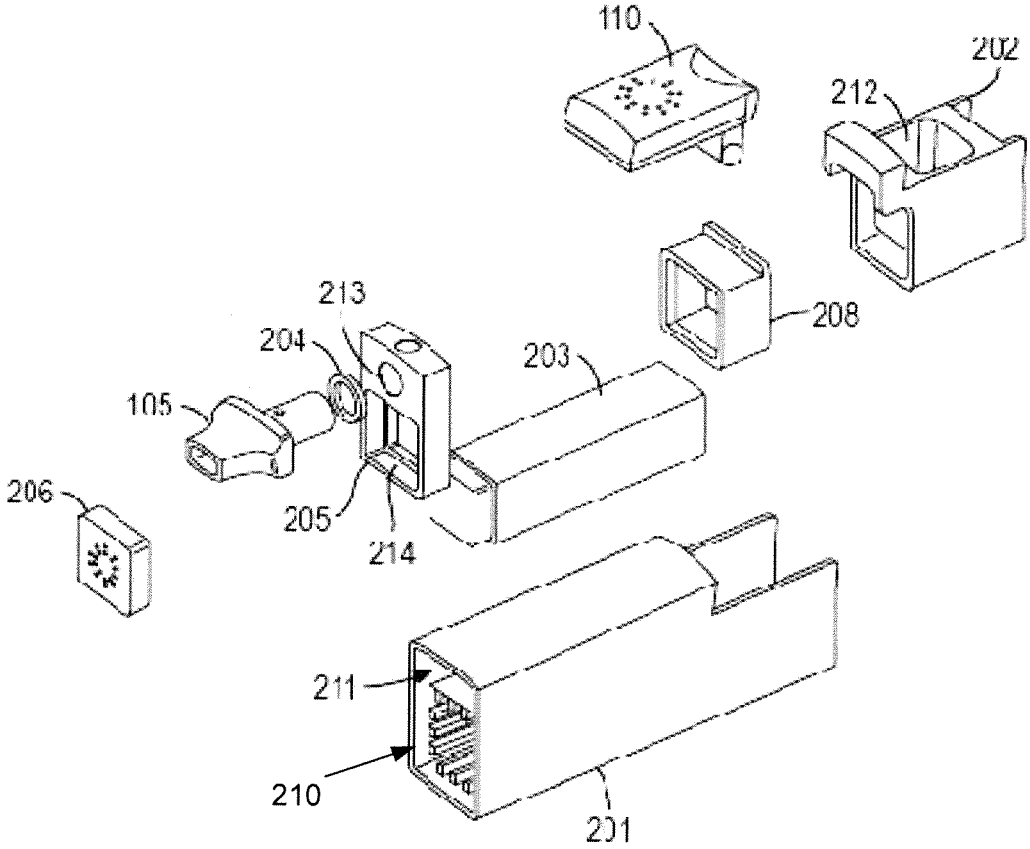
FIG. 2 is an exploded view of the pipe of FIG. 1, in accordance with an embodiment.

FIG. 2 shows an exploded view of the pipe 100 (shown in FIGS. 1*a*-1*e*), in accordance with an embodiment of the present invention.

The pipe 100 includes a body 201 with two channels, namely, a lower channel 210 and an upper channel 211. An end cap 208 with a through-hole (not shown in FIG. 2) is positioned on the rear end of the lower channel 210. A bowl housing 202, possibly made of aluminum, is positioned near the rear side of the body 201, behind the end cap 208. Although not shown, bowl vents may be disposed on the underside of the bowl 212. The shape of the bowl housing 202 allows air to be drawn through the bowl vents on the underside of the bowl 212 to an intermediate chamber behind the end cap 208 and through the upper channel 211. Although not shown, in some embodiments, an inhalation filter may be positioned in the upper channel 211. The shape of the bowl housing 202 also allows air to pass from the upper channel to the intermediate chamber under the bowl 212, through the end cap 208, and through the lower channel 210.

A fitting 205 is positioned in the front end of the body 201. The fitting 205 includes two passageways, namely, an upper passageway 213 that interfaces with the upper channel 211 and a lower passageway 214 that interfaces with the lower channel 210. In some embodiments, the fitting 205 is attached airtight to the body 210, e.g., using glue. The upper passageway 213 may be configured to accept the mouthpiece 105 mounted therein, possibly with an o-ring 204 therebetween to create an airtight seal. The lower passageway 214 may be configured to accept an exhalation filter cartridge 203 into the lower channel 210 and an exhalation vent cap 206. In some embodiments, the exhalation vent cap 206 is removable to allow replacement of the exhalation filter cartridge 203. In some embodiments, the end cap 206 is part of or integrated with the exhalation filter cartridge 203.

The pipe 100 includes an inhalation path and an exhalation path. As shown and described with reference to the pipe 100, the inhalation path and exhalation path of pipe 100 overlap. To ensure that air is not drawn from the exhalation filter cartridge 203 during inhalation and that air is not forced through the combustion bowl 212 during exhalation, one or more one-way inhalation valves and one or more one-way exhalation valves may be employed. In some embodiments, the one-way inhalation valve may be attached to the flip top lid 110. In some embodiments, the one-way inhalation valve may be a flap (similar to the flap 303 of FIG. 3) positioned on the under side of the flip-top lid 110. Therefore, during exhalation, the inhalation flap prevents air from exiting the flip-top lid 110, and forces the air through the lower channel. In some embodiments, a one-way exhalation valve may be disposed in or on the exhalation filter cartridge 203, in the body 201, on the end cap 208, or in the exhalation vent cap 206. In some embodiments, the one-way exhalation valve may be a flap (similar to the flap 303 of FIG. 3) positioned on the front side of the end cap 208. Thus, during inhalation, the flap prevents air from being drawn from the lower channel 210, and allows air to flow through the lower channel.

Figure 3:
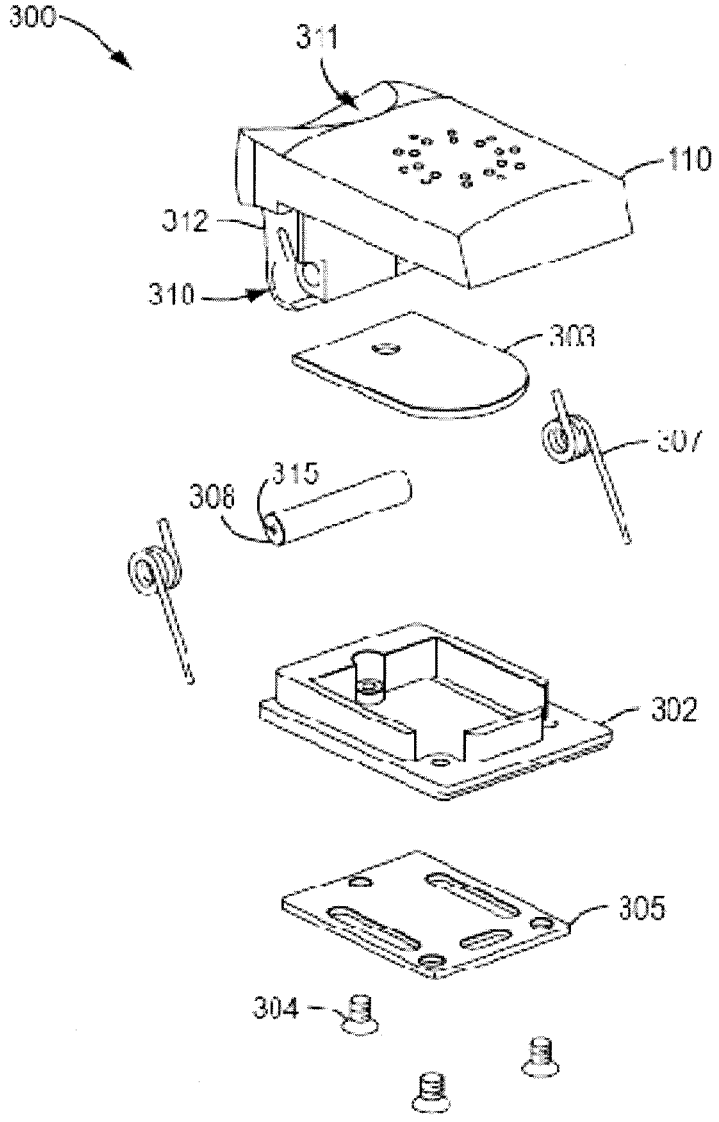
FIG. 3 is an exploded view of the flip-top lid assembly of the pipe of FIG. 1, in accordance with an embodiment.

FIG. 3 is an exploded view of a flip-top lid assembly 300, in accordance with some embodiments. The flip-top lid assembly 300 includes the flip-top lid 110 with inhalation vents 120 therethrough, a rear wall 312 extending downward from the backside of the lid 110, a pivot bore 310 through the rear wall 312 from the left to the right, and a finger lever 311 that when positioned on the body 201 extends past the rear side 154 to cause rotation of the flip-top lid about the pivot bore 310 when pressed upon. A first dowel 308 is inserted into the pivot bore 310 and lee torsion springs 307 are attached to the first dowel 308. The first dowel 308 may include a dowel bore 315 therethrough.

As shown, a one-way inhalation flap 303 may be attached to the lid 110 to prevent airflow out of the inhalation vents 120. A lid gasket 302 may be positioned on the underside of the lid 110, and held in place by a combustion bowl plate 305. The combustion bowl plate 305 may be secured to the lid 110 using screws 304. It will be appreciated that the combustion bowl plate 305 may be made of metal to protect the gasket 302 and the one-way inhalation flap 303 from damage by the burning combustible substance in the bowl 212.

Figure 4:
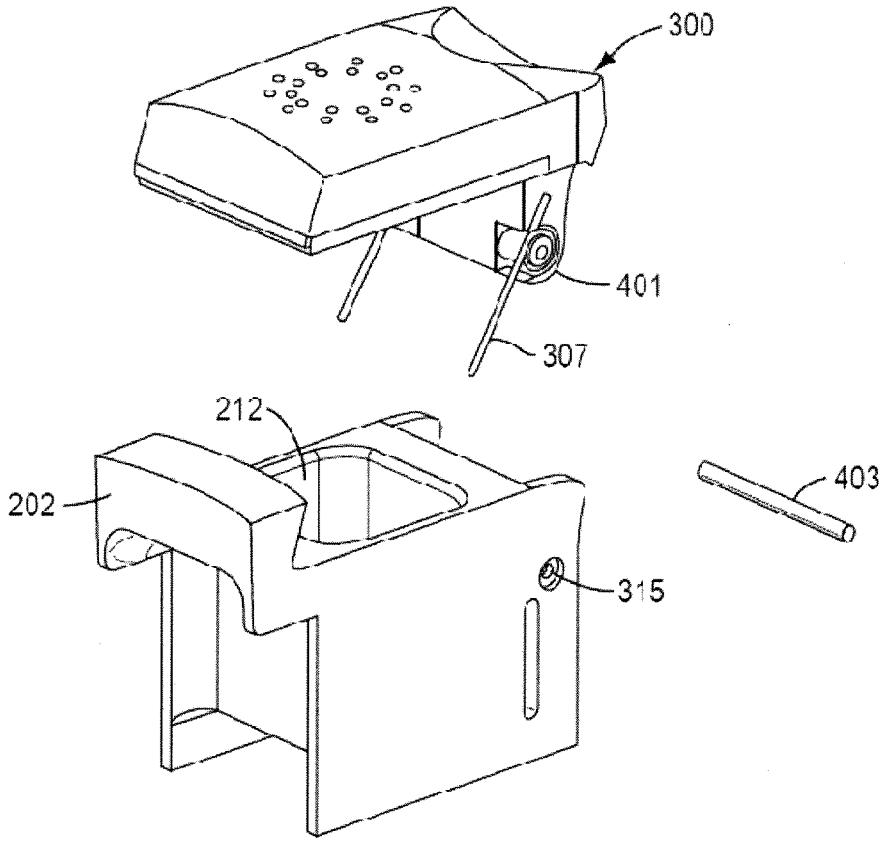
FIG. 4 is an exploded view of the flip-top lid assembly of FIG. 2 positioned for connection to the bowl housing of FIG. 1, in accordance with an embodiment.

FIG. 4 is an exploded view of the flip-top lid assembly 300 positioned for connection to the bowl housing 202. As shown, a second dowel 403 may be positioned through holes 402 in the bowl housing 202 and through the dowel bore 315 of the first dowel 308. It will be further appreciated that the lee torsion springs 307 may be used to bias the flip-top lid 110 in a closed and to press the lid gasket 302 in an airtight position on the bowl housing 202. Pressing on the finger lever 311 causes a rotational force to counter the bias of the springs 307, thus opening the flip-top lid assembly 300 to expose the bowl 212.

FIGS. 5*a*-5*f* illustrate the internal details of the pipe 100, in accordance with an embodiment of the present invention.

Figure 5C:
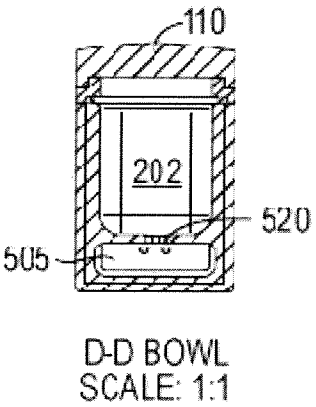
FIGS. 5*a*-5*f* illustrate the internal details of the pipe of FIG. 1, in accordance with an embodiment.
Figure 5B:
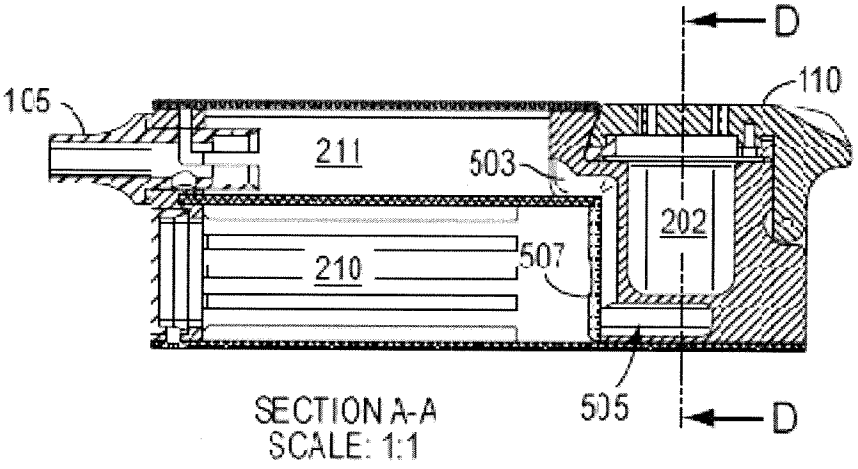
Figure 5A:
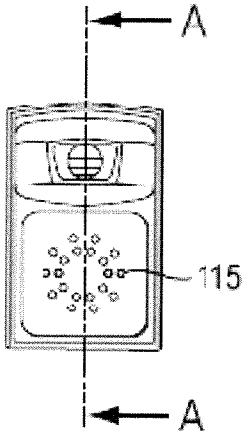

FIG. 5*a* illustrates a front view of the pipe 100, and identifies plane A-A half way between the left and right sides of the front face.

FIG. 5*b* illustrates a sectional view of the pipe 100 at plane A-A. When the flip-top lid 110 is open or closed, inhalation draws air from the mouthpiece 105, which draws air from the upper channel 211, which draws air from an intermediate path 503, which draws air from a intermediate chamber 505 under the bowl 212. A one-way exhalation flap 507 prevents air from being drawn from the lower channel 210 and the exhalation filter cartridge 203. Instead, air is drawn through bowl vents 520 on the underside of the bowl 212, which draws smoke from the burning combustible substance in the bowl 212. This may be referred to as the "inhalation path," in this embodiment. During exhalation, air is forced into the mouthpiece 105, which forces air into the upper chamber 211, which forces air through the intermediate path 503 to the intermediate chamber 505. The one-way inhalation flap 303 in the flip-top lid assembly 300 (see FIG. 3) prevents air from being forced through combustion bowl 202. Instead, the one-way exhalation flap 507 in the lower channel 210 opens, allowing the air to pass into the lower channel 210, though the exhalation filter cartridge 203, and out the exhalation vents 115. In some embodiments, the exhalation flap 507 (or some other one-way exhalation valve) may be positioned in this and/or other locations, such as in the exhalation filter cartridge 203 or near the exhalation vents 115. This may be referred to as the "exhalation path," in this embodiment.

FIG. 5*c* illustrates a sectional view of the rear portion of the pipe 100 through the bowl 212. As shown, bowl housing 202 includes bowl vents 520 between the bowl 212 and the chamber 505.

Figure 5D:
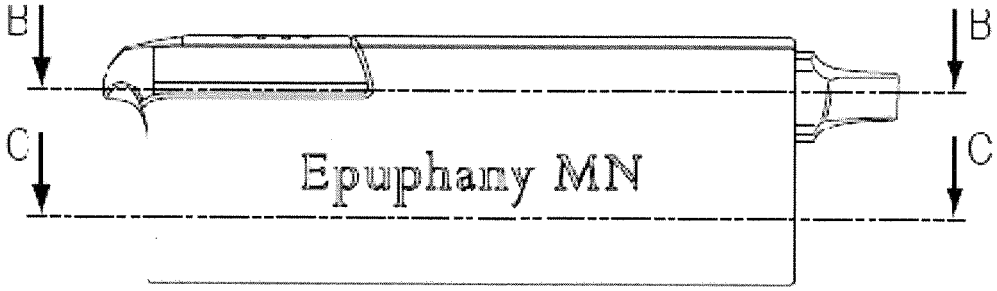

FIG. 5*d* illustrates a side view of the pipe 100, in accordance with an embodiment of the present invention. FIG. 5*d* defines plane B-B as a section through the upper channel 211 and defines plane C-C as a section through the lower channel 210.

Figure 5E:
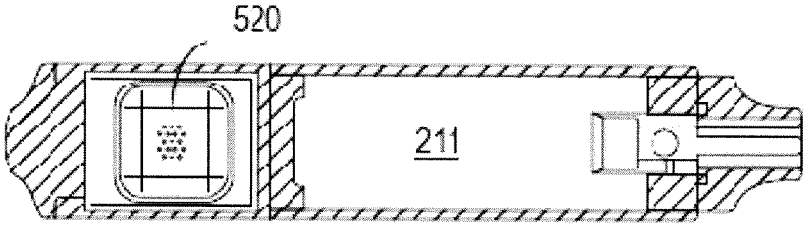

FIG. 5*e* illustrates sectional view of plane B-B of the pipe 100. As shown, the bottom of the bowl 212 includes bowl vents 520.

Figure 5F:
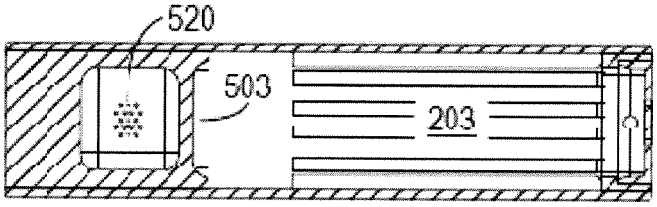

FIG. 5*f* illustrates sectional view at plane C-C of the pipe 100. As shown, in an embodiment, the lower channel 210 may include ridges that cooperate with ridges on the exhalation filter cartridge 203.

Figure 6:
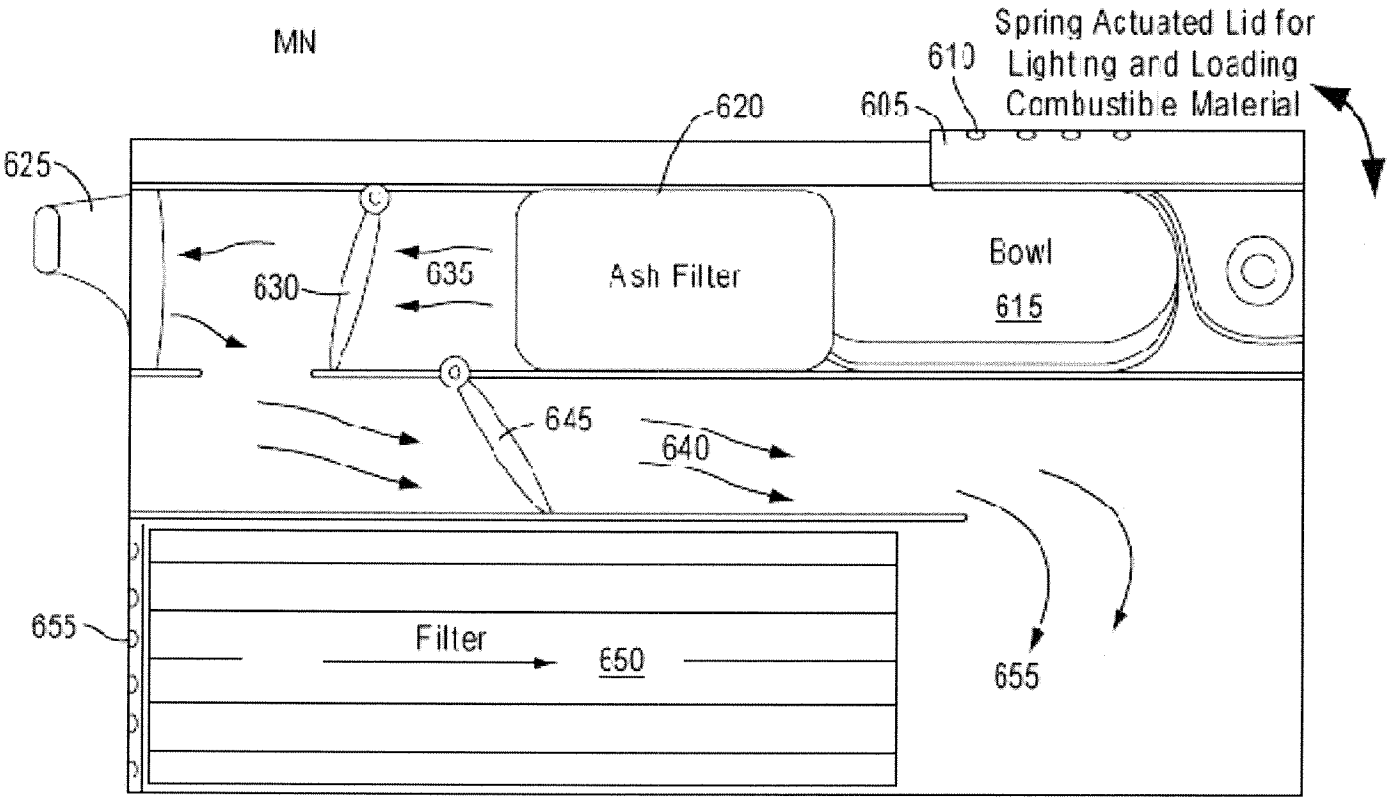
FIG. 6 is a sectional view of a smoke and odor elimination smoking pipe, in accordance with an embodiment.

FIG. 6 is a sectional view of an example pipe 500, in accordance with an embodiment of the invention. The pipe 500 includes an upper channel 635, a lower channel 655, and an intermediate channel 640. An exhalation filter 650 is positioned in the lower channel 655. A one-way exhalation valve 645 is positioned in the intermediate channel 640. A one-way inhalation valve 630 is positioned in the upper channel 635. A mouthpiece is positioned at the front side of the upper channel 635 of the pipe 500. A flip-top lid 605 is positioned at the rear side of the upper channel 635 of the pipe 500. A combustion bowl 615 is positioned under the flip-top lid 605. An inhalation filter 620 is positioned between the bowl 615 and the mouthpiece 625 in the upper channel 635. Exhalation vents 655 are positioned in the front side of the lower channel 655 of the pipe 500.

Accordingly, during inhalation, air is drawn from the mouthpiece 625. The one-way inhalation valve 630 allows air to pass through the upper channel 635, through the inhalation filter 620, and from the combustion bowl 615. The exhalation valve 645 prevents air from being drawn from the lower channel 655. During exhalation, air is forced into the mouthpiece 625, which forces air through the intermediate channel 640 via the one-way exhalation valve 645, to the lower channel 655, through the exhalation filter 650 and out the exhalation vents 655. The one-way inhalation valve 630 prevents are being exhaled through the inhalation filter 620 or the combustion bowl 615.

Figure 7:
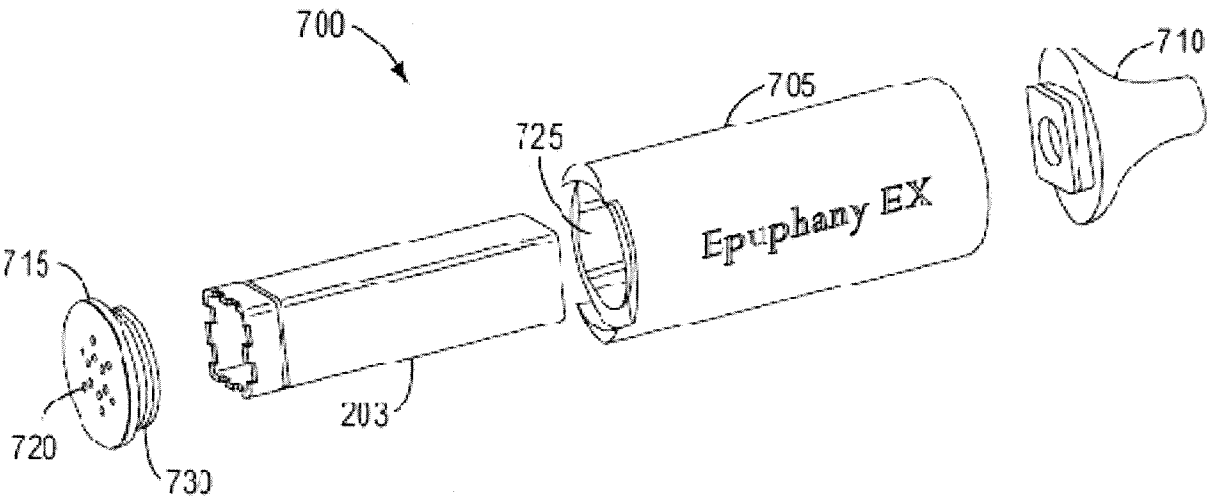
FIG. 7 illustrates an exploded view of an exhalation pipe, in accordance with an embodiment.

FIG. 7 illustrates an exploded view of an exhalation pipe 700, in accordance with an embodiment of the present invention.

As shown, the exhalation pipe 700 includes an elliptical body 705 with a filter channel 725 therethrough, threading (not shown) on the rear internal side of the elliptical body 705, and a passageway (not shown) on the front side. A mouthpiece 710 is attached onto the front side of the elliptical body (possibly with glue). An exhalation filter cartridge 203 is inserted into the filter channel 725. An end cap 715 includes exhalation vents 720 and threading 730 that cooperates with the threading in the body 705.

In use, the smoker inhales smoke from a cigarette, pipe, bong, cigar or other smoking apparatus. The smoker then exhales through the mouthpiece 710. The smoke travels through the mouthpiece 710, through the passageway, into the channel 725, through the exhalation filter cartridge 203, and out the exhalation vents 720. The filter 203 scrubs the smoke and odor particles.

In some embodiments, the body 705 may be made of extruded aluminum, plastic, ferrous metals, precious metals, etc. The mouthpiece 710 may be machined stainless steel, plastic, ferrous metals, precious metals, etc. The end cap 715 may be machined stainless steel, plastic, ferrous metals, precious metals, etc.

FIGS. 8*a*-8*d* illustrate an exhalation pipe 700.

Figure 8B:
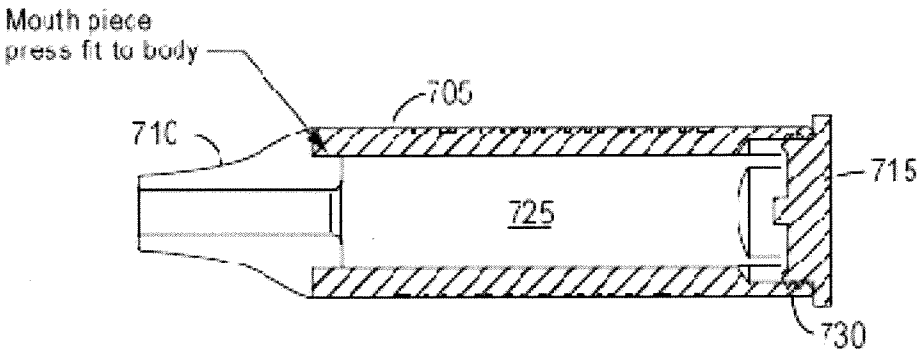
FIGS. 8*a*-8*d* illustrate details of the exhalation pipe of FIG. 7, in accordance with an embodiment.
Figure 8A:
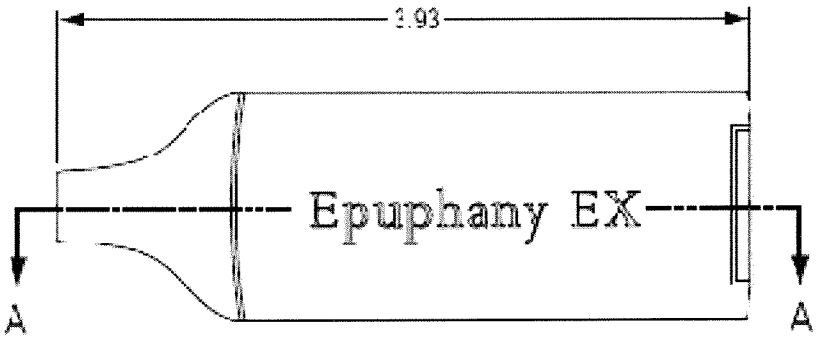

FIG. 8*a* illustrates a side view of the exhalation pipe 700. As shown, the pipe 700 may be about 4 inches in length, e.g., 3.93 inches. FIG. 8*a* defines plane A-A.

FIG. 8*b* illustrates a sectional view of exhalation pipe 700 at plane A-A. As shown, the pipe 700 includes a mouthpiece press fit to the body 705. The end cap 715 is screwed onto the body 705 via threading 730.

Figure 8C:
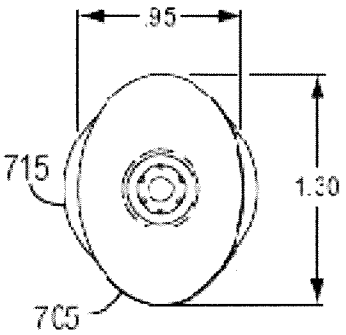

FIG. 8*c* illustrates a front view of the pipe exhalation 700. As shown, in some embodiments, the pipe 700 is about 1.3 inches across the longitudinal axis of the elliptical body 705 and about 0.95 inches across the latitudinal axis of the elliptical body 705. The diameter of the circular end cap 715 may be about 1.3 inches, allowing portions of it to extend beyond the body 705 for easy rotational manipulation by the user.

Figure 8D:
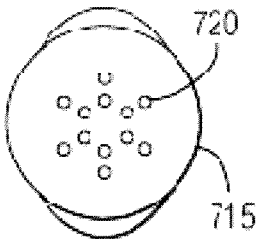
Figure 9A:
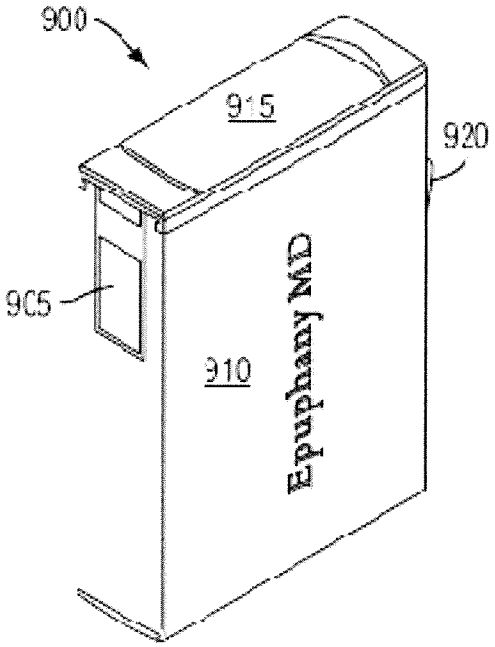
FIGS. 9*a*-9*e* illustrate a smoke and odor elimination smoking pipe, in accordance with an embodiment.
Figure 9C:
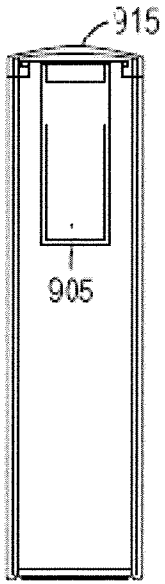
Figure 9E:
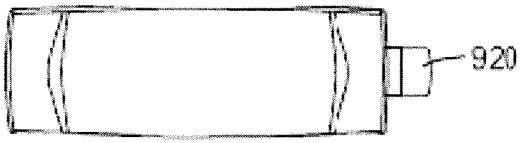
Figure 9B:
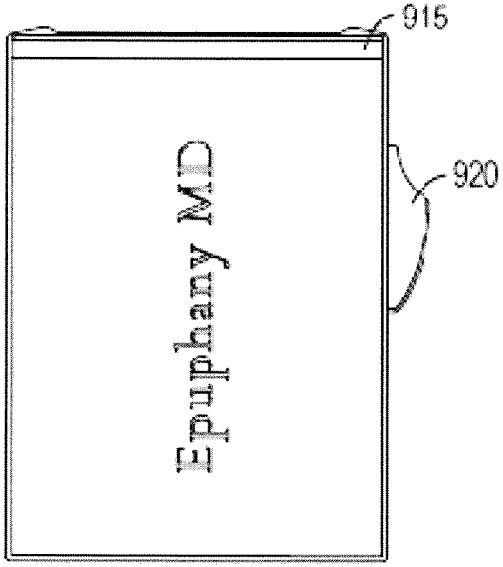
Figure 9D:
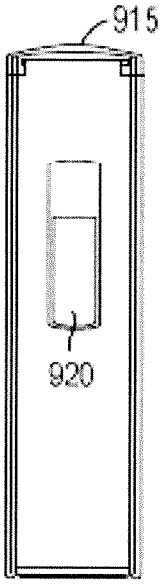

FIG. 8*d* illustrates a rear view of the exhalation pipe 700. As shown, the end cap 715 includes exhalation vents 720.

FIGS. 9*a*-9*e* illustrate a pipe 900, in accordance with an embodiment of the present invention. As will be described in more detail below, the pipe 900 includes a combustion section, a filter cartridge section, as well as an internal lighter section.

In some embodiments, the pipe 900 is about 4 inches tall (top to bottom), 3 inches long (front to rear), and ⅞ inches wide (left to right). As shown, the pipe 900 includes a body 910. A mouthpiece 905 is rotatably attached to the front side of the body 910. A cap 915 is slidably mounted on the top of the body 905. Sliding the cap 915 forward exposes the combustion bowl (not shown) therein. Sliding the cap 915 towards the rear will allow the mouthpiece 905 to flip open. In some embodiments, sliding the cap forward after opening the mouthpiece secures the mouthpiece in its open position. An ignition switch 920 ignites the internal lighter, which causes combustible substance in the combustion bowl to ignite. The smoker can inhale the smoke through the mouthpiece 905 via an inhalation path and exhale the smoke through the same mouthpiece via an exhalation path to filter the smoke and odor.

Figure 10A:
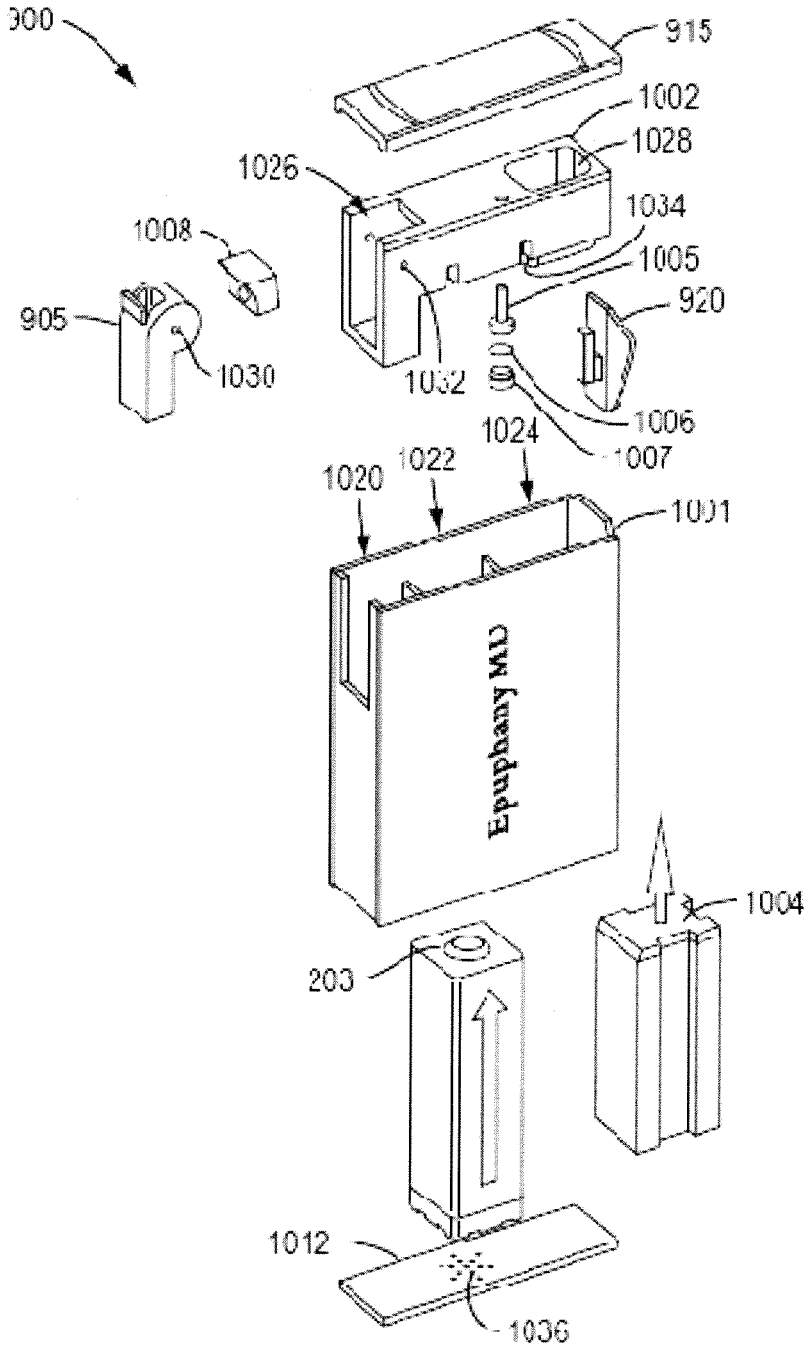
FIG. 10*a* illustrates an exploded view of the pipe of FIGS. 9*a*-9*e*, in accordance with an embodiment.

FIG. 10*a* is an exploded view of the pipe 900, in accordance with some embodiments of the present invention. The pipe 900 includes a body 1001 having three channels, namely, a front channel 1020, a center channel 1022, and a rear channel 1024. An exhalation filter cartridge 203 is positioned in the center channel 1022. A lighter 1004 is positioned in the rear channel 1024. A bottom cap 1012 with exhalation vents 1036 may be slidably mounted on the bottom of the body 1001.

The front channel 1020 may be used for storage of combustible substance. This storage may be locked in place using spring-loaded ball bearings that drop into receiving indents on the compartment. Some embodiments may use a swing out storage hinged along the vertical edge of the compartment and the device. Other embodiments may use a fold back compartment that is hinged at the bottom of the compartment and device.

A fitting 1005 may be inserted into the top side of the body 1001, above the three channels. The fitting 1005 may include a mouthpiece attachment portion 1026 in the front of the fitting 1005. A mouthpiece 905 and mouthpiece seal 1008 may be attached to the mouthpiece attachment portion 1026. In some embodiments, the mouthpiece seal 1008 includes five flat faces and one arcuate face. The arcuate face may cooperate with an arcuate section of the mouthpiece 905 to enable the mouthpiece 905 to rotate from a position flush with the front face of the body 1001 to a position normal to the front face of the body 1001. A pin (not shown) may be slidably inserted through holes 1032 in the fitting 1002 and through a pivot bore 1030 in the mouthpiece 905. When the mouthpiece 905 is inserted into the body 1001, the dowel may be held in place by the side walls of the body 1001.

The fitting 1002 may also include notches 1034, which abut the top portion of the walls dividing the body 1001 into its three channels. The notches 1034 may provide a better airtight seal between the fitting 1002 and the body 1001. The fitting 1002 also includes a combustion bowl 1028, possibly made of aluminum, with flame access holes (not shown) on the bottom side of the bowl 1028. The fitting 1002 may be attached to the body 1001, possibly using glue, to provide an airtight seal.

A top lid 915 may be slidably attached to the fitting 1002 or the body 1001. A spring pin 1005, washer 1006 and set screw 1007 may cooperate with the top lid 915 to retain the lid 915 in open or closed position. Some embodiments of the device may use a porcelain lighter compartment top dome insert and a combustion chamber insert to help contain heat generated during combustion.

An external ignition switch 920 may be slidably mounted through the body 1001 to engage an internal ignition switch on the lighter 1004. Upon activation, the lighter will ignite causing a flame through the flame access holes under the combustion bowl 1028, causing the combustible substance to burn.

Like the pipe 100, the pipe 900 will include an inhalation path from the combustion bowl through an inhalation filter to the mouthpiece 905 and an exhalation path from the mouthpiece 905 through the exhalation filter cartridge 203 and out the exhalation vents 1036.

Figure 10B:
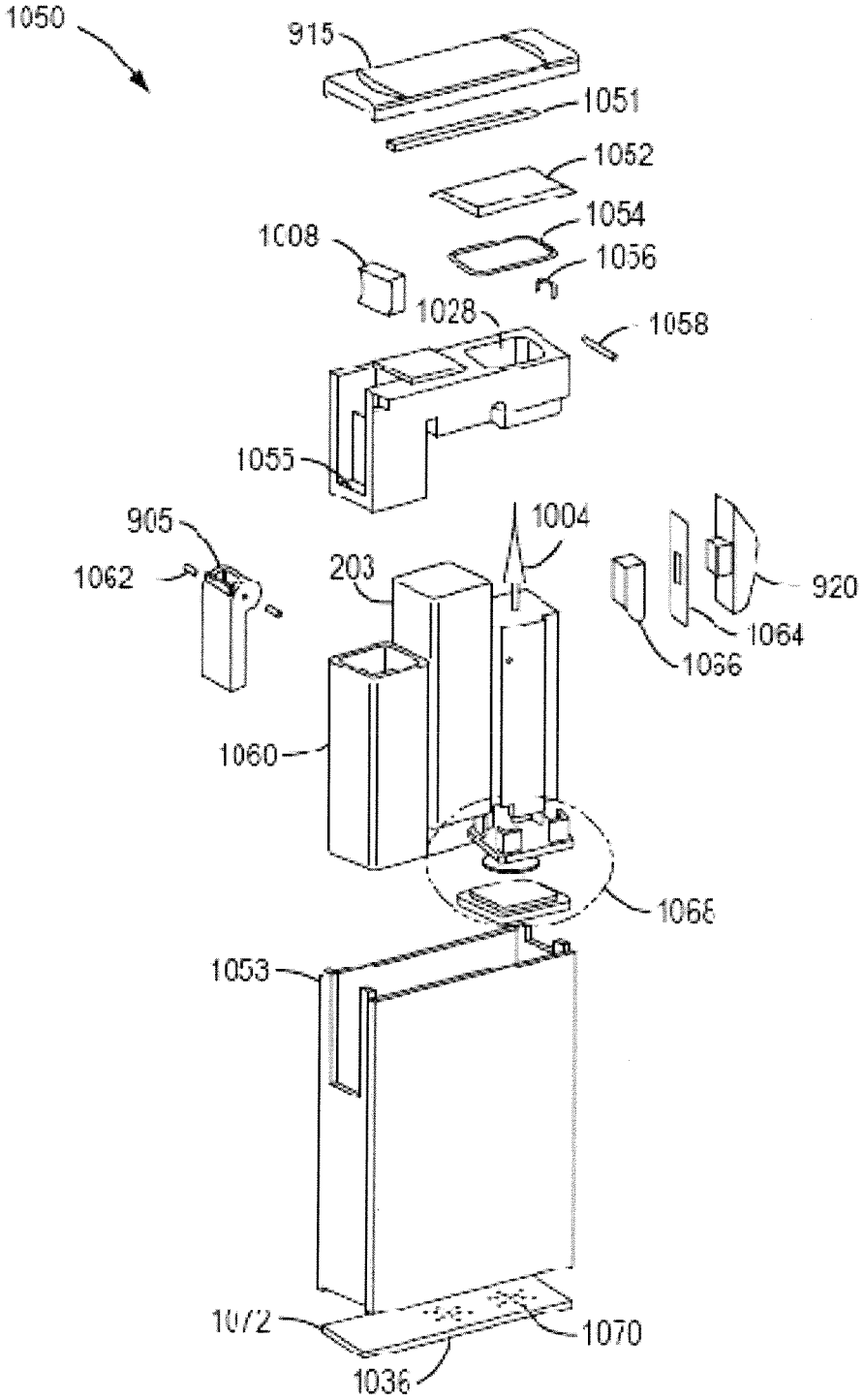
FIG. 10*b* illustrates an exploded view of the pipe of FIGS. 9*a*-9*e*, in accordance with an embodiment.

FIG. 10*b* is an exploded view of a pipe 1050, in accordance with an embodiment of the present invention. The pipe 1050 is similar to the pipe 900 described above with reference to FIGS. 9 and 10*a*. In this case, pipe 1050 includes a body 1053 with no channels therein. A storage chamber 1060, exhalation filter cartridge 203, and lighter assembly 1004 are disposed into the body 1053 tightly against the inside walls of the body 1053 and tightly against each other, thus dividing the body into three sections, similar to the pipe 900. A fitting 1055 similar to fitting 1002 is inserted above the three sections. Like the fitting 1002, the fitting 1055 creates the channels for separate inhalation and exhalation paths. The fitting 1055 supports mouthpiece 905, using dowels 1062 and mouthpiece seal 1008. A bowl lid 1054, gasket 1056, spring 1056 and pin 1058 cooperate to form a flip-top lid assembly over the bowl 1028 in the fitting 1054. Lighter cap assembly 1068 is positioned at the bottom of the lighter assembly 1004 to enable airflow, possibly one way, to the lighter assembly 1004 as needed through a lighter vent 1070 in the bottom cap 1072. A top cover wear-strip 1051 may be attached to the top cap 915 to enable the top cap 915 to slide comfortably and not loosely across the top of the body 1053 or fitting 1053. An ignition switch assembly including ignition switch 920, ignition switch wear surface 1064 and slider block 1066, enables the user to ignite the lighter, which burns the combustible substance.

Figure 11C:
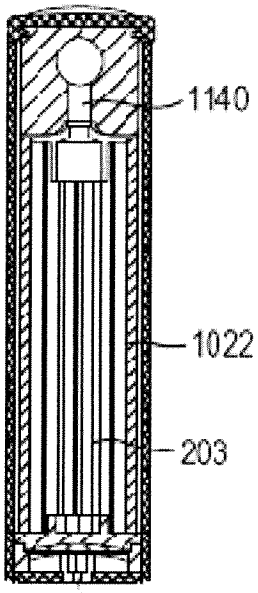
FIGS. 11*a*-11*c* illustrate details of the pipe of FIGS. 9*a*-9*e*, in accordance with an embodiment.
Figure 11B:
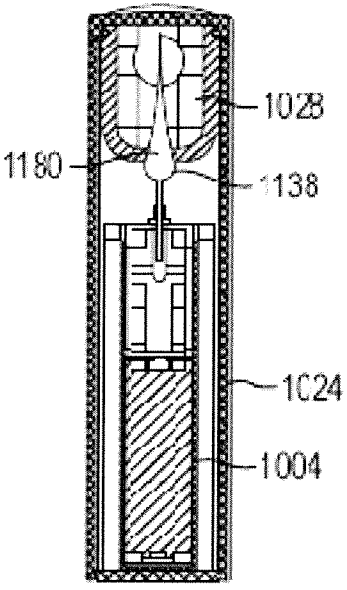
Figure 11A:
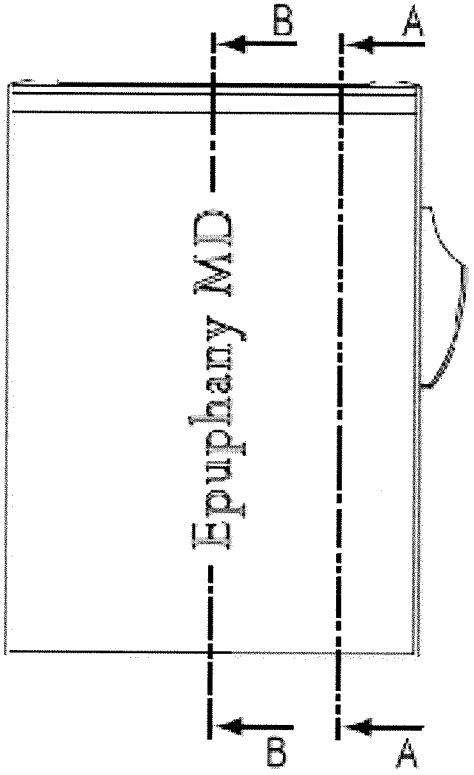

FIG. 11*a* is a side view of the pipe 900, in accordance with an embodiment. FIG. 11*a* defines plane A-A through the center of the rear channel 1024 and plane B-B through the center of the center channel 1022.

FIG. 11*b* is a sectional view of the pipe 900 at plane A-A. As shown, the lighter 1004 is positioned within the rear channel 1024. Upon ignition, the lighter 1004 causes a flame 1138 to pass through flame access holes 1180 in the combustion bowl 1028.

FIG. 11*c* is a sectional view of the pipe 900 at plane B-B. As shown, the exhalation filter cartridge 203 is inserted into the center channel 1022 above the exhalation vents 1036. The exhalation filter cartridge 203 also cooperates with an intermediate channel 1140 from which it receives air exhaled from the smoker.

Figure 12C:
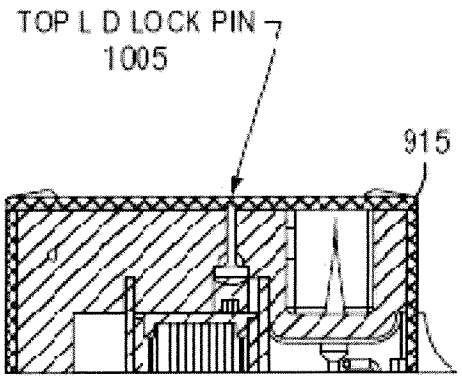
FIGS. 12*a*-12*c* illustrate the pipe of FIGS. 9*a*-9*e*, in accordance with an embodiment.
Figure 12B:
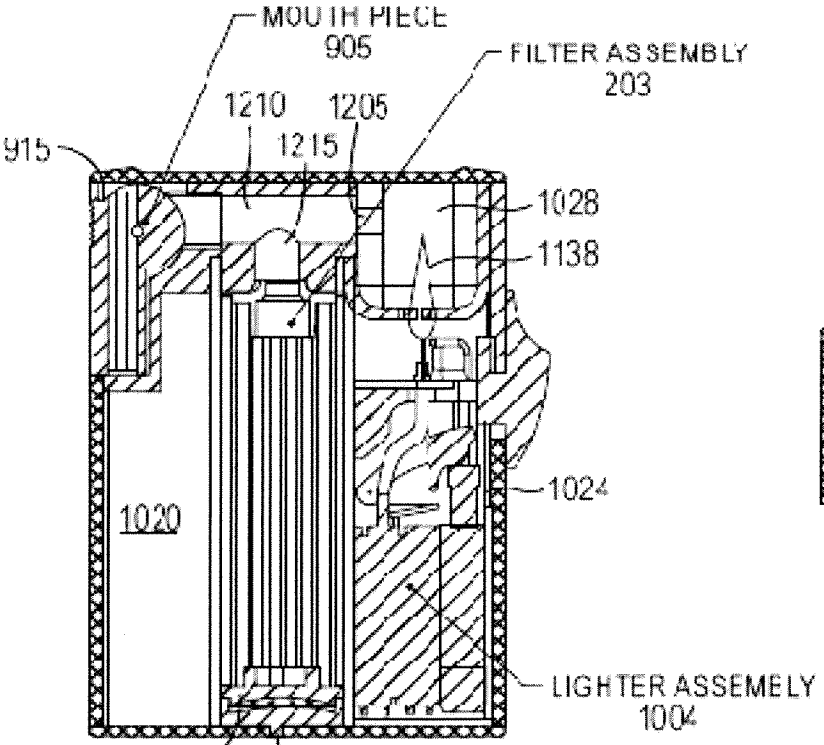
Figure 12A:
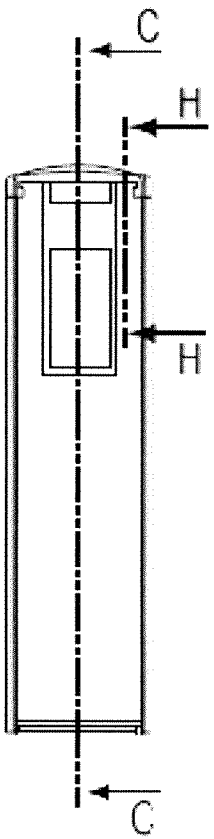

FIGS. 12*a*-12*c* illustrate the pipe 900, in accordance with some embodiments. FIG. 12*a* is a front view of the pipe 900 and defines a plane C-C through the center of the front face and a plane H-H at about the ¾ position of the front face from the left side.

FIG. 12*b* is a sectional view of the pipe 900 at plane C-C. As shown, a storage chamber 1020 is positioned in the front channel 1022, the exhalation filter cartridge 203 is positioned in the center channel 1022, and the lighter 1004 is positioned in the rear channel 1024 under the combustion bowl 1028. A one-way inhalation valve 1205 is positioned between the combustion bowl 1028 to enable smoke to transfer from the combustion bowl 1208 through the intermediate channel 1210 to the mouthpiece 915. A one-way exhalation valve 1215 may be positioned between the intermediate channel 1210 and the center channel 1022 to enable exhaled smoke to transfer from mouthpiece 915 through the intermediate channel 1210 to the center channel 1022 and exhalation filter cartridge 203 and out the exhalation vents 1036. Alternatively or additionally, a one-way exhalation valve 1215 may be positioned inside the exhalation filter cartridge 203 as described below.

FIG. 12*c* is a sectional view of the pipe 900 at plane H-H. As shown, the pin 1005 is positioned to lock the top lid 915.

Figure 13:
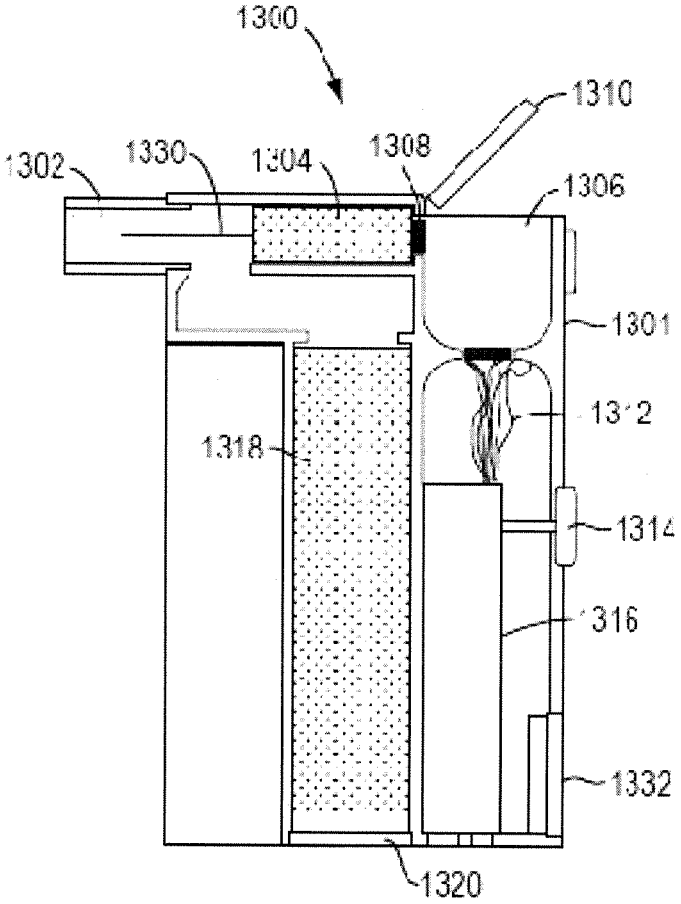
FIG. 13 is a sectional side view of a smoke and odor elimination smoking pipe, in accordance with an embodiment.

FIG. 13 is a sectional side view of a pipe 1300, in accordance with an embodiment of the present invention. As shown, the pipe 1300 includes a mouthpiece 1302 in a pipe body 1301. The mouthpiece 1302 is operatively coupled to an inhalation filter 1304, which is operatively coupled via a one-way inhalation valve 1308 to a combustion bowl 1306. A flip-top lid 1310 is positioned over the combustion bowl 1306. The mouthpiece 1302 is also operatively coupled to an exhalation filter channel 1318 with exhalation filter media therein. An outlet cap 1320 with an integral one-way exhalation valve is positioned at the bottom end of the exhalation filter channel 1318. A lighter 1316 is positioned in a channel below the combustion bowl 1306. The lighter 1316 may receive air through a lighter air vent 1332 (possibly with a check valve). An ignition switch 1314 extends through the pipe body 1301 to enable user activation of the lighter 1316. In one embodiment, during an inhalation phase, the ignition switch 1314 is depressed for one second before the person begins to inhale. During inhalation, the smoke is drawn from combustion bowl 1306, through the one-way inhalation valve 1308, through the inhalation filter 1304, and through the mouthpiece 1302. During exhalation, smoke is past through the mouthpiece 1302, through the exhalation filter channel 1318 (and exhalation filter media), and through outlet cap 1320. In some embodiments, the inhalation filter 1304 may be replaced by removing the mouthpiece 105 and pulling on a cartridge removal grip 1330 which protrudes into the mouthpiece 105.

Figure 14:
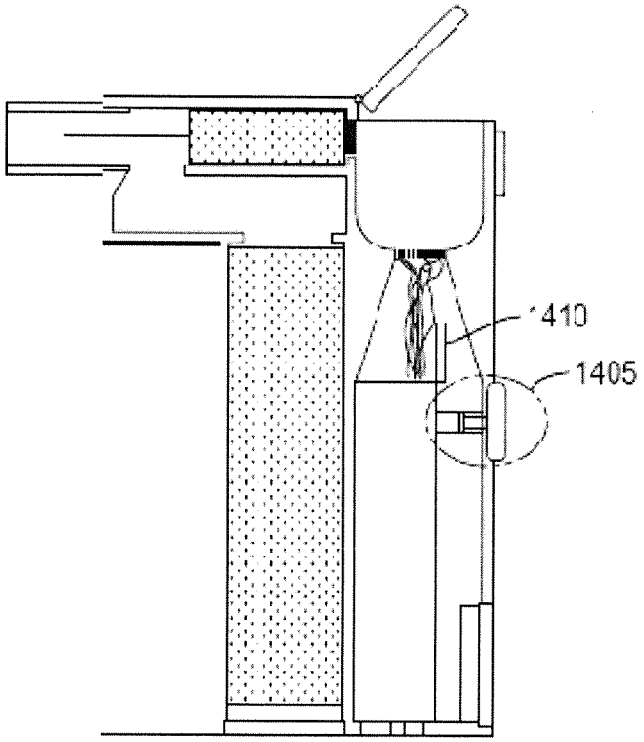
FIG. 14 is a sectional side view of a smoke and odor elimination smoking pipe, in accordance with an embodiment.

FIG. 14 is a sectional side view of a pipe 1400, in accordance with an embodiment of the present invention. As shown, the pipe 1400 is similar to the pipe 1300, except with a timed ignition button assembly 1405 and a lighter dust cover 1410. The ignition button assembly 1405 ensures that the lighter is not on too long to insure that the device does not generate enough heat to be a source of injury. The lighter dust cover 1410 ensures that dust does not impede ignition of the flame.

Figure 15:
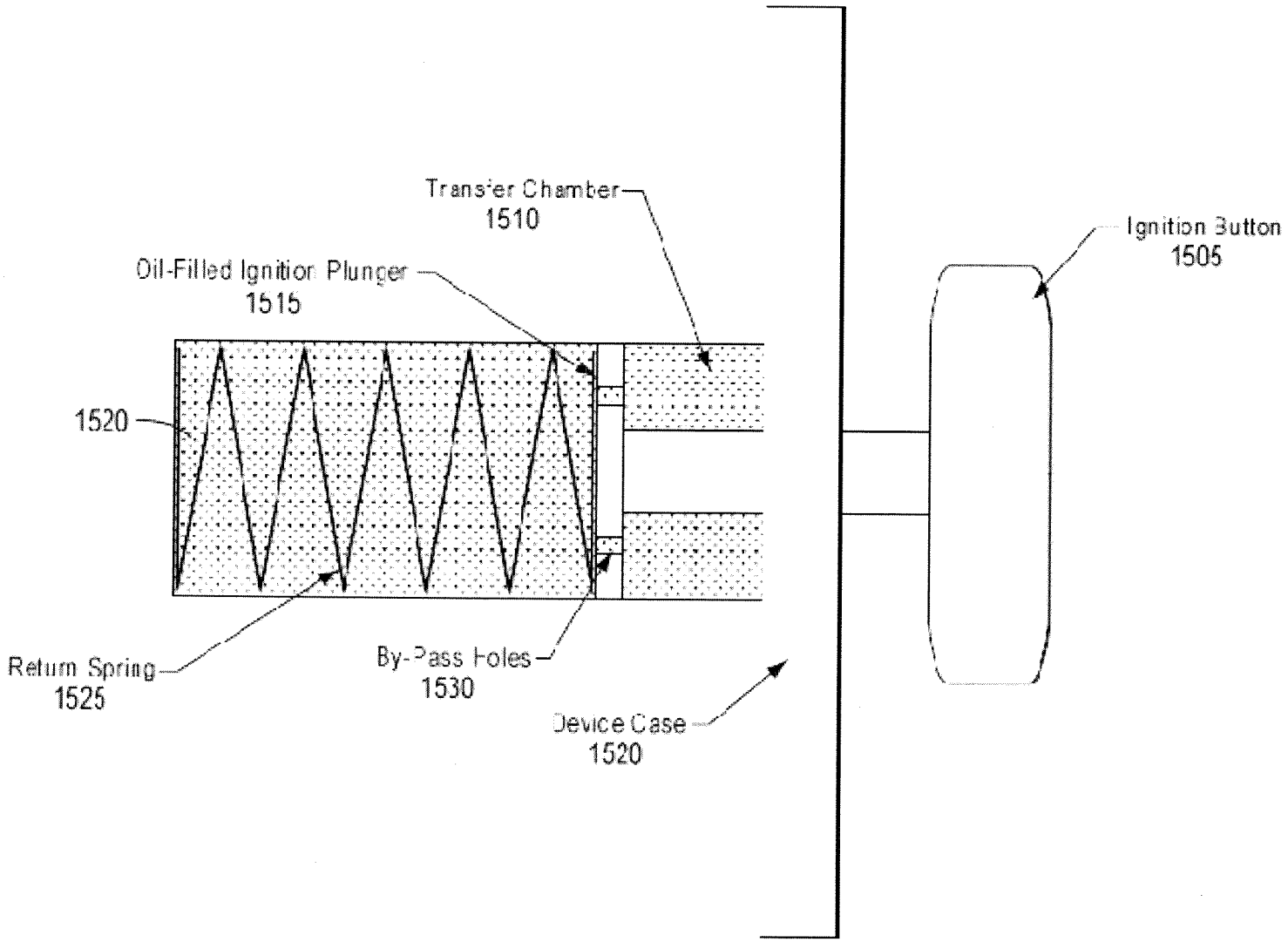
FIG. 15 is a section side view of the ignition button assembly of FIG. 14, in accordance with an embodiment.

FIG. 15 illustrates details of the ignition button assembly 1405, in accordance with an embodiment of the present invention. The ignition button assembly 1405 includes an external ignition button 1505, a primary oil-filled chamber 1520, a transfer chamber 1510, and a return spring in the primary chamber 1520. As pressure is applied to the external ignition button 1505, oil from the primary chamber 1520 passes through holes 1530 in the plunger 1515 into the transfer chamber 1510, slowly releasing pressure on the ignition switch 1505. Once the oil has traveled into the transfer chamber 1510, the ignition switch 1505 is released and the oil is allowed to return to the primary chamber 1520, whereby the process may be repeated.

Figure 16A:
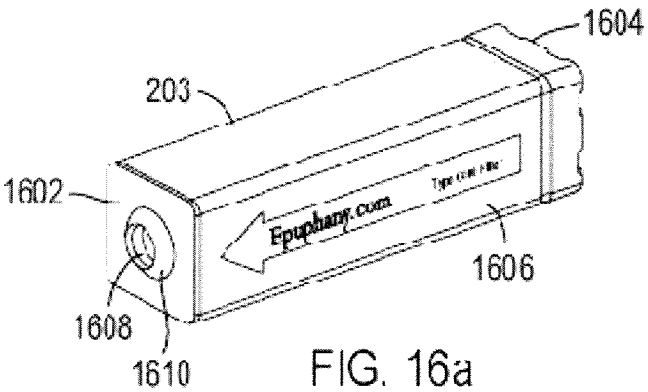
FIGS. 16*a*-16*e* illustrate the exhalation filter cartridge, in accordance with an embodiment.
Figure 16B:
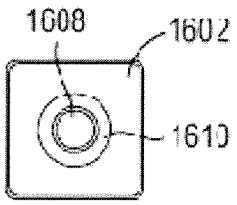
Figure 16C:
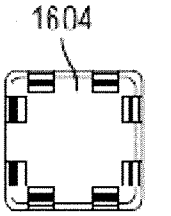
Figure 16D:
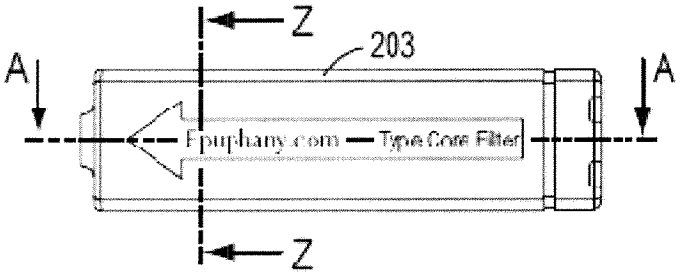
Figure 16E:
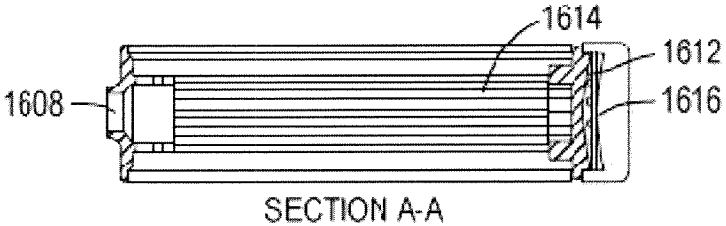

FIGS. 16*a*-16*e* illustrate the exhalation filter cartridge 203, in accordance with an embodiment. FIG. 16*a* is a perspective view of the exhalation filter cartridge 203, which includes a front face 1602, rear face 1604 and a central body 1606 (in this case, with a square cross section). The front face 1602 includes an opening 1608 for receiving the smoke and odor exhaled from the smoker. In this case, the opening 1608 is round with a raised lip 1610 around the perimeter of the round opening 1608. The raised lip 1610 helps to create an airproof seal in the exhalation paths of the pipes. FIG. 16*b* is a front view of the front face 1602 of exhalation filter cartridge 203. FIG. 16*c* is a rear view of the rear face 1604 of the exhalation filter cartridge 203. FIG. 16*d* is a side view of the exhalation filter cartridge 203 and defines a plane A-A and plane Z-Z. FIG. 16*e* is a sectional view of the exhalation filter cartridge 203 at plane A-A. As shown, the exhalation filter cartridge 203 includes opening 1608, filter media 1614, an end cap 1612, and filter exhalation vents 1616 in the end cap 1612.

Figure 17A:
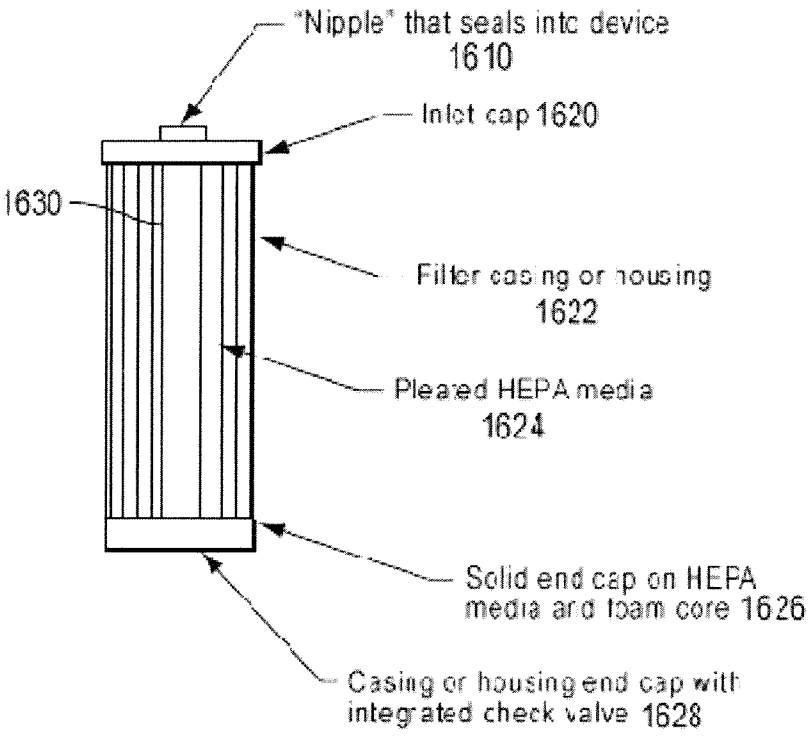
FIGS. 17*a* and *b* illustrate details of the exhalation filter cartridge of FIGS. 16*a*-16*e*, in accordance with an embodiment.

FIGS. 17*a* and *b* illustrate details of the exhalation filter cartridge 203, in accordance with an embodiment of the present invention. FIG. 17*a* is a sectional side view of the exhalation filter cartridge 203. As shown, the exhalation filter cartridge 203 includes an inlet cap 1620, an outlet cap 1628, and a filter casing 1622 therebetween. The inlet cap 1620 includes a raised lip (or "nipple") that engages a corresponding shape inside a pipe, so that substantially all smoke exhaled passes through the filter media 1614. A pleated HEPA filter 1624 is positioned inside the exhalation filter cartridge 203, between the inlet cap 1620, the outlet cap 1628, and the filter casing 1622. HEPA material rated at as little as a 95% rating will trap the smoke particles. A foam core 1630 is positioned between the inlet cap 1620 and the outlet cap 1628 and within the pleated HEPA filter 1624. For example, the foam core 1630 may be manufactured from core of 60 pours-per-inch (PPI can be higher or lower) polyether polyurethane foam (or other foam).

Figure 17B:
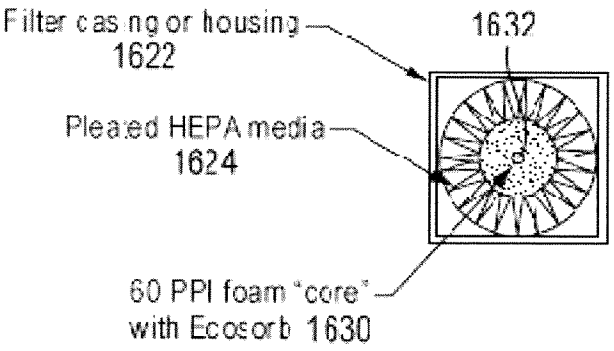

FIG. 17*b* is a sectional view of the exhalation filter cartridge 203 at plane Z-Z. As shown, the exhalation filter cartridge 203 includes a foam core 1630, which is surrounded by the pleated HEPA filter 1624, which is surrounded by the filter casing 1622. The foam core 1630 includes a central bore 1632, preferably extending the length of the foam core 1630. The central bore 1632 allows the smoke to pass through the length of the foam core 1630, before being forced laterally through the foam core 1630 and HEPA filter 1624. Although not shown, a metal cap may be positioned at the bottom end of the foam core 1630 and HEPA filter 1624 to stop the downward flow of smoke and odor particles before being allowed to exit out the outlet cap 1628, and to force the smoke and odor particles laterally towards the filter casing 1622. The foam core 1630 may be infused with a odor capturing substance, e.g., odor absorbing materials such as Ecosorb® odor-absorbing products manufactured by OMI Industries. Citrus, mint and/or cinnamon extracts (or other extracts) can additionally or alternatively be added to the oil to provide a selection of scents.

In some embodiments, the odor absorbing materials react on a molecular level to neutralize smoke odors, preferably involving adsorption, absorption, gas solubility and reaction. For example, when Ecosorb® oil is diluted with water and broadcast via atomization, the tiny water droplets created contain a thin oil skin that creates an electrostatic charge. This charge facilitates adsorption of the odor molecules onto the droplet surface. The gas is absorbed by the droplet (solubility) and held.

Figure 18:
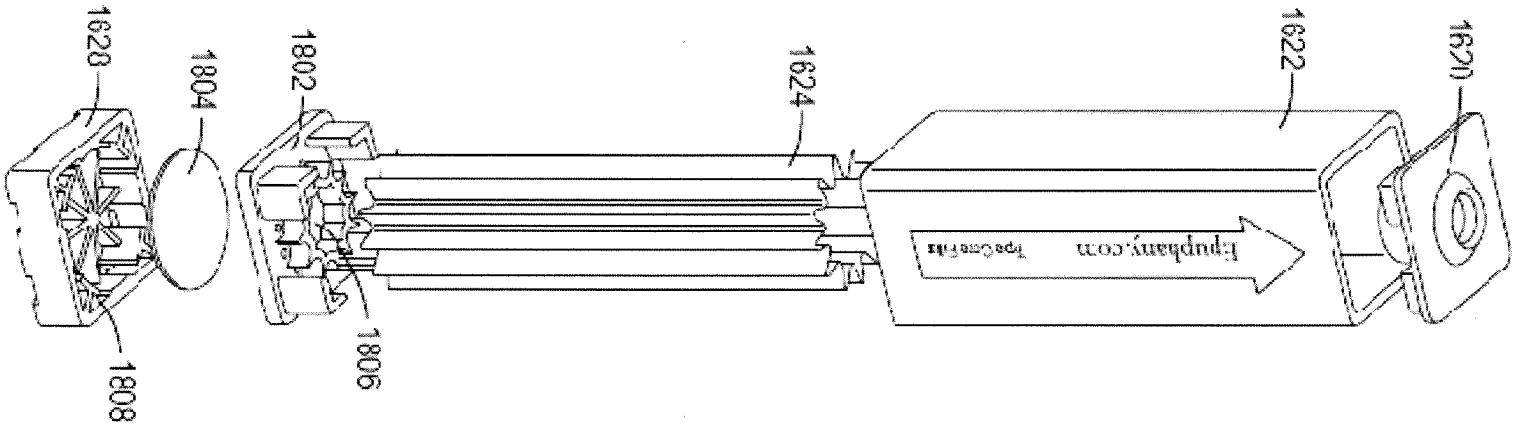
FIG. 18 is an exploded view of the exhalation filter cartridge of FIGS. 16*a*-16*e*, in accordance with an embodiment.

FIG. 18 is an exploded view of the exhalation filter cartridge 203, in accordance with an embodiment of the present invention. As shown, the exhalation filter cartridge 203 includes a filter casing 1622. The inlet cap 1620 is positioned on the top side of the filter casing 1622 to form the front face 1602. The HEPA filter 1624 is positioned inside the filter casing 1622. An internal filter cap 1802 is positioned on the bottom side of the filter casing 1622 to support the HEPA filter 1624 and create an exhalation hole 1806 to allow exhaled air to pass therethrough. Although not shown, the foam core 1630 is positioned inside the HEPA filter 1624. A flap 1804, possibly made of rubber (e.g. Viton® rubber), is positioned on the bottom side of the internal filter cap 1802 to cover the exhalation hole 1806. An outlet cap 1628 is positioned over the internal filter cap 1802 and the round flap 1804, supporting the round flap between the internal filter cap 1802 and the outlet cap 1628. The outlet cap 1628 includes exhalation vents 1808 outside the boundaries of the flap 1804. Accordingly, during exhalation, air can pass through the exhalation hole 1806, past the round flap 1804, and out the exhalation vents 1808. During inhalation, the flap 1804 is drawn up to cover the exhalation hole 1806, preventing air to flow through the exhalation filter cartridge 203.

Figure 19:
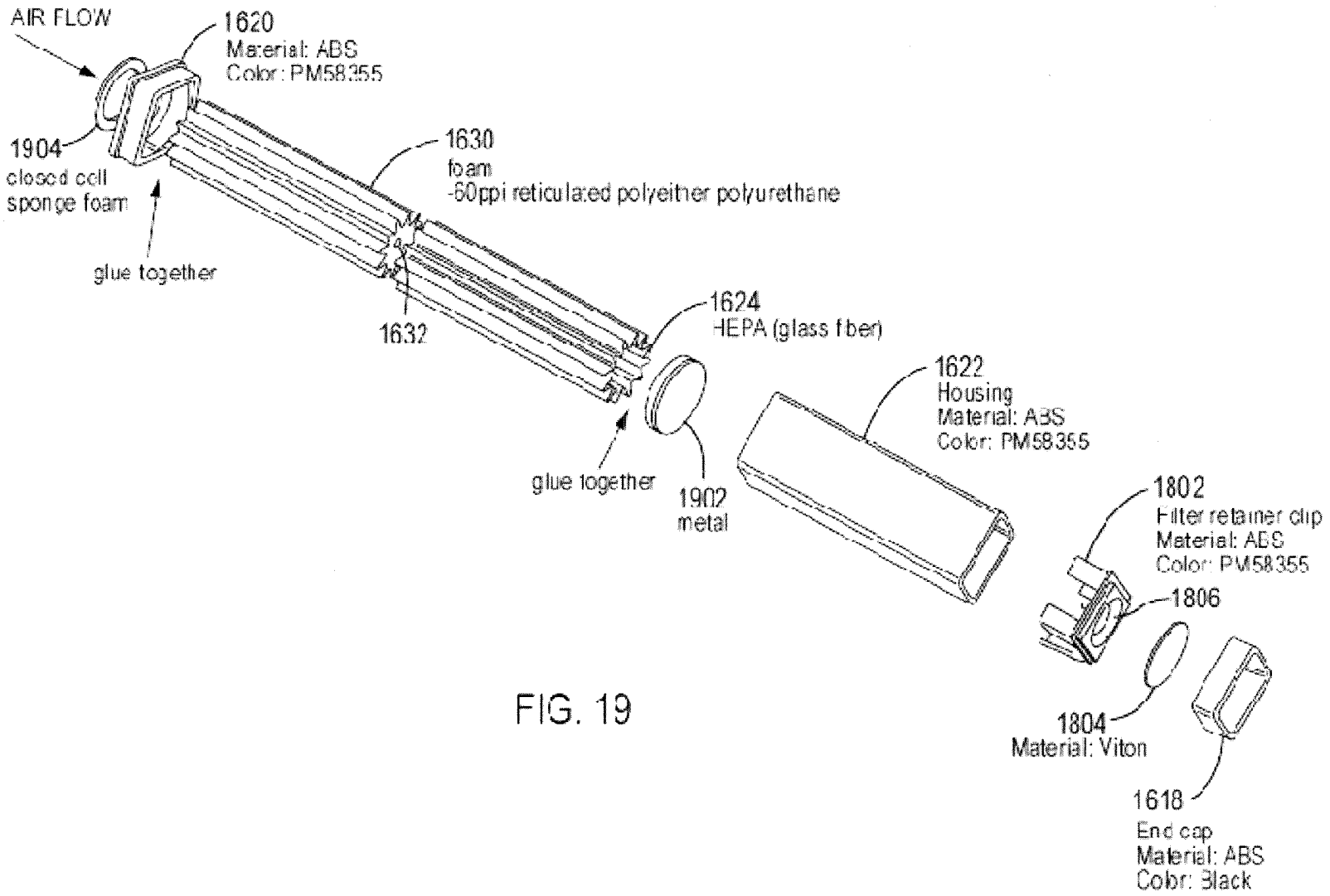
FIG. 19 is an exploded view of the exhalation filter cartridge of FIGS. 16*a*-16*e*, in accordance with an embodiment.

FIG. 19 is an exploded view of the exhalation filter cartridge 203, in accordance with an embodiment of the present invention. As shown, the exhalation filter cartridge 203 includes a filter casing 1622. The inlet cap 1620 is positioned over the top end of the filter casing 1622. A sponge foam seal 1904 may be positioned over the inlet cap 1620 to enable an airproof seal with the pipe body. The internal filter cap 1802 is positioned at the bottom of the filter casing 1622. The flap is positioned over the exhalation hole 1806. The outlet cap 1628 is positioned over the internal filter cap 1802 and the outlet cap 1628. The foam core 1620 is positioned inside the pleated HEPA filter 1624, which is positioned inside the filter casing 1622. The top of the HEPA filter 1624 and foam core 1630 may be fused or glued to the inlet cap 1620.

As stated above with reference to FIG. 18*b*, the foam core 1630 includes a central bore 1632, extending the length of the foam core 1630. The central bore 1632 allows the smoke to pass through the entire length of the foam core 1630, before being forced through the foam core 1630 and HEPA filter 1624. A metal cap 1902 is positioned at the bottom end of the foam core 1630 and HEPA filter 1624 to force the smoke laterally towards the filter casing 1622 before being allowed to exit out the outlet cap 1628. In this embodiment, the metal cap 1902 is round and the cross section of the filter casing 1622 is square. Accordingly, the metal cap 1902 forces the air to pass down the central bore 1632, laterally through the foam core 1630, laterally through the HEPA filter 1624, and out the corners that extend beyond the circumference of the round metal cap 1902.

It will be appreciated that some embodiments may use natural or synthetic fibers, ceramic, metal, chemicals, oils and/or crystals for filtering.

Figure 20C:
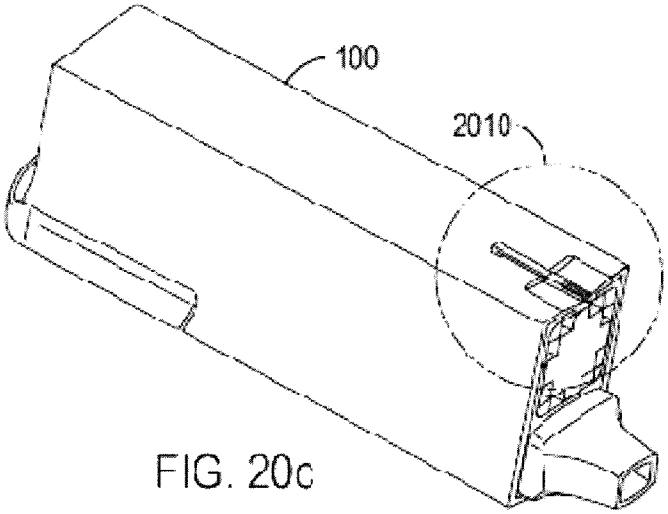
FIGS. 20*a*-20*d* illustrate an exhalation filter cartridge with a retaining clip, in accordance with an embodiment of the present invention.
Figure 20D:
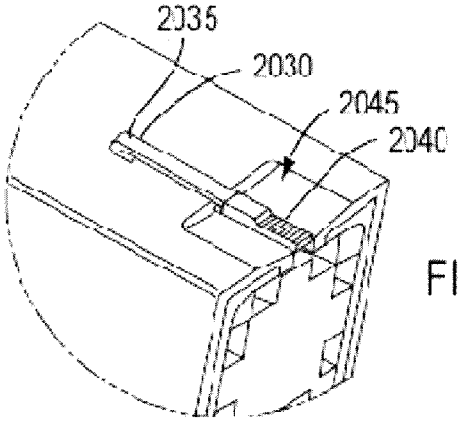
Figure 20A:
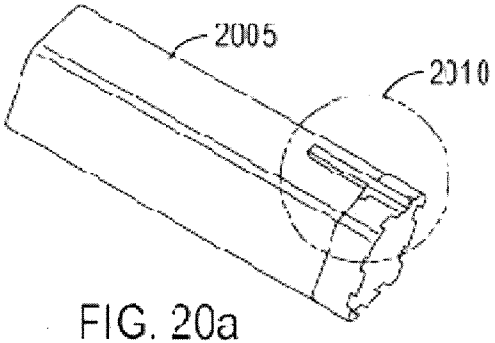
Figure 20B:
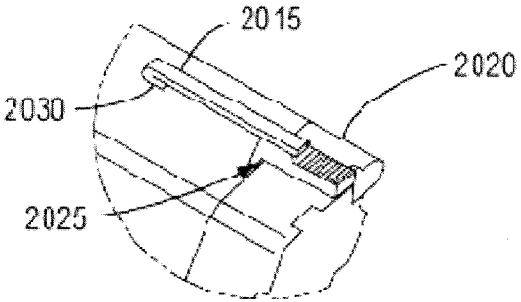

FIGS. 20*a*-20*d* illustrate an exhalation filter cartridge 2005 with a retaining clip 2010, in accordance with an embodiment of the present invention. FIG. 20*a* is a perspective view of the exhalation filter cartridge 2005. As shown, the exhalation filter cartridge 2005 includes a retaining clip 2010 attached to the end portion of the exhalation filter cartridge 2005. The exhalation filter cartridge 2005 includes an end cap (similar to end cap 206) with exhalation vents (similar to exhalation vents 115) therein. FIG. 20*b* is a close-up of the retaining clip 2010. As shown, the retaining clip 2010 may be a rocker type clip, with a forward arm 2015 with a downward flanging tip 2030, a rear arm 2020, and a pivot base 2025 between the two arms. Depressing the rear arm 2020 will cause the pivot base 2025 to pivot and the forward arm 2015 to raise. FIG. 20*c* is a perspective view of the exhalation filter cartridge 2005 positioned in the pipe 100. FIG. 20*d* is a close-up of the retaining clip 2010 when the exhalation filter cartridge 2005 is positioned in the pipe 100. In this embodiment, the pipe 100 includes a hole 2035 configured to receive and retain the downward flanging tip 2030 of the forward arm 2015, and a slot 2040 to receive the rear arm 2020. The pipe 100 also includes a recessed portion 2045 to enable a user to apply downward pressure on the rear aim 2020, when the exhalation filter cartridge 2005 is positioned in the pipe 100. Other retaining clip options are possible.

Some embodiments may use a warning system that will alert the user and others that exhalation has not gone back through the pipe. This alarm or alerting system will have an adjustable timer of from 5 seconds to 30 seconds after which the alarm or alert will sound. The use of this alarm or alerting system will assist in the training of the user to always exhale through the device. Over time, the proper use of this device will become habit.

The exhalation filter cartridge 203 may be designed to be inserted into the series of devices.

Figures 21A, 21B:
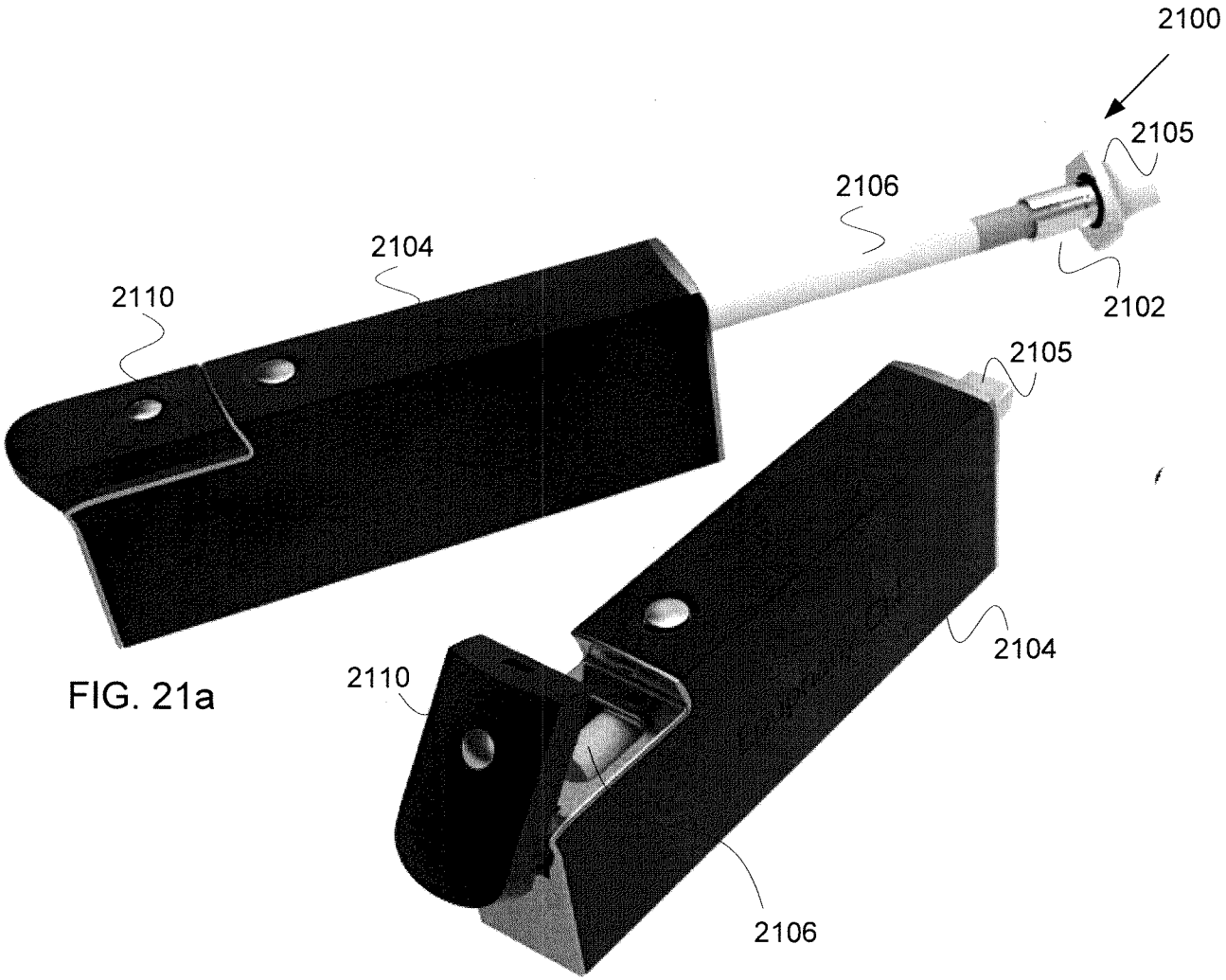
FIGS. 21*a* and 21*b* illustrate two views of a smoke and odor elimination cigarette-smoking pipe, in accordance with an embodiment of the present invention.

FIGS. 21*a* and 21*b* illustrate two perspective views of a smoke and odor elimination cigarette-smoking pipe 2100, in accordance with an embodiment of the present invention. As shown, the pipe 2100 comprises a body 2104 having a flip-top lid 2110. A mouthpiece 2105 may be operatively connected to the body 2104 and may have a sleeve 2102 sized to hold a cigarette 2106. The cigarette 2106 may be inserted into the sleeve 2102 and inserted into the body 2104. A smoker opens the flip-top lid 2110 to expose and ignite the tip of the cigarette 2106. A smoker may use the mouthpiece 2105 to inhale from and exhale into the body 2104.

Figures 22A, 22B, 22C, 22D:
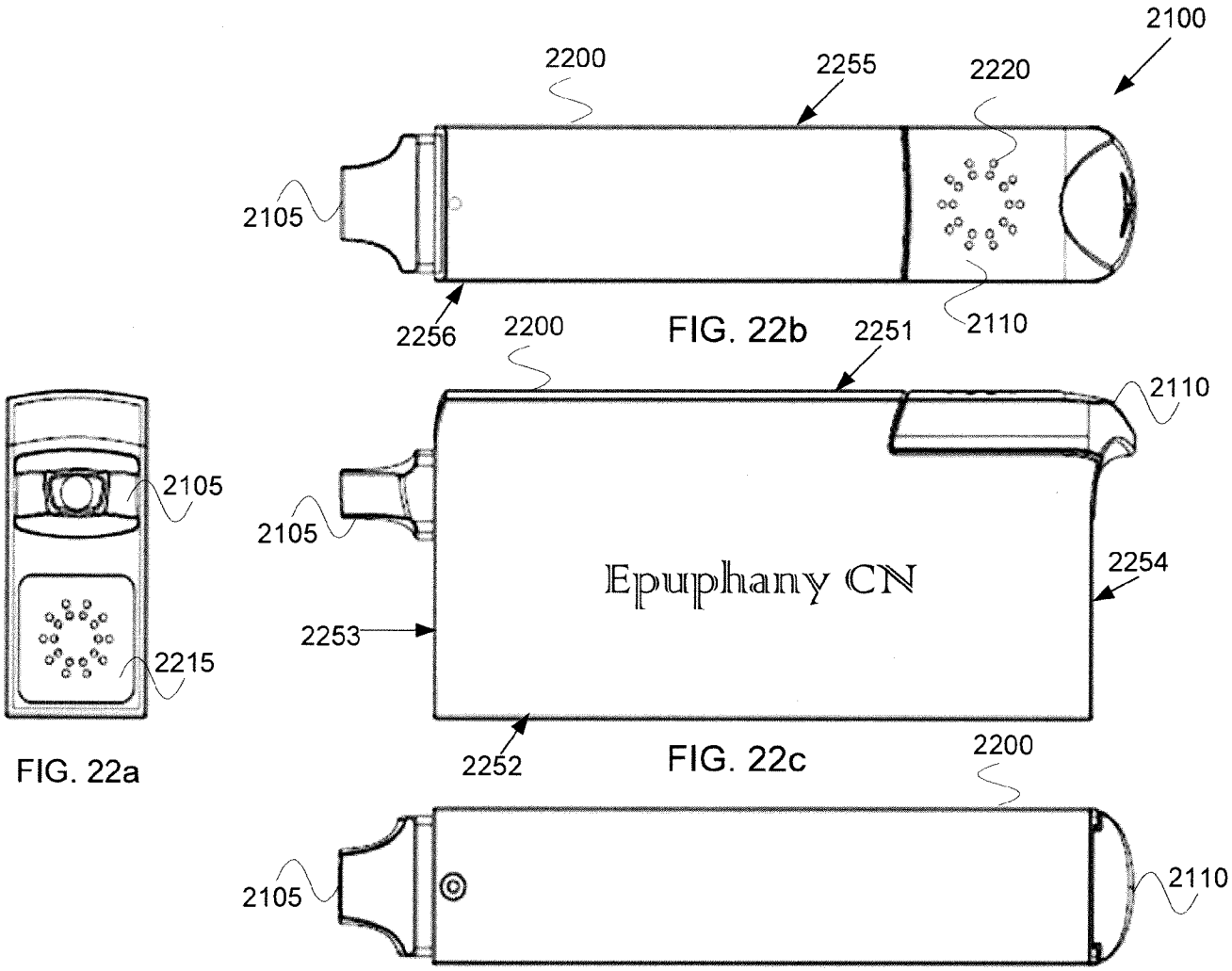
FIGS. 22*a*-22*d* illustrate different views of a smoke and odor elimination cigarette-smoking pipe, in accordance with an embodiment of the present invention.

FIGS. 22*a*-22*d* illustrate a smoke and odor elimination cigarette-smoking pipe 2100, in accordance with an embodiment. FIG. 22*a* illustrates a front view of the pipe 2100. FIG. 22*b* illustrates a top view of the pipe 2100. FIG. 22*c* illustrates a side view of the pipe 2100. FIG. 22*d* illustrates a bottom view of the pipe 2100.

As shown, the pipe 2100 comprises six sides, namely a top side 2251, a bottom side 2252, a front side 2253, a rear side 2254, a left side 2255, and a right side 2256. The pipe 2100 includes a mouthpiece 2105, one-way exhalation vents 2215 on the front side 2253, and a flip-top lid 2110 with one-way inhalation vents 2220 on the top side 2251. The mouthpiece 2105 is coupled to an inhalation path (not shown in FIGS. 22*a*-22*d*) and an exhalation path (also not shown in FIGS. 22*a*-22*d*). Each of the inhalation path and the exhalation path are described below with respect to FIGS. 24*a*-24*f*.

The pipe 2100 includes a combustion chamber (not shown in FIGS. 22*a*-22*d*) capable of receiving a cigarette 2106 (also not shown in FIGS. 22*a*-22*d*). To operate the pipe 2100, a smoker opens the lid 2110, lights the tip of the cigarette 2106, and inhales through the mouthpiece 2105. While the lid 2110 is open or closed, airflow causes the cigarette 2106 to burn and smoke to pass through the inhalation path in the pipe 2100 via an inhalation filter (not shown in FIGS. 22*a*-22*d*) and out the mouthpiece 2105 to the smoker. After the lid 2110 has closed, air can still be drawn through the one-way inhalation vents 2220. The lid 2110 is closed for exhalation. When the smoker exhales through the mouthpiece 2105, the smoke passes through the exhalation path in the pipe 2100, including through an exhalation filter (not shown in FIGS. 22*a*-22*d*) and out of the exhalation vents 2215. The exhalation filter scrubs and significantly limits the smoke and odor particles that exits to the environment and substantially limit the effects of second and thirdhand smoke.

As shown, the lid 2110 may have a form similar to flip-top lid assembly 300 of FIGS. 3 and 4 described above. Further, the pipe 2100 may be about 4 inches long (front to rear), 1.5 inches tall (top to bottom), and ⅞ inch wide (left to right). Components of the pipe 2100 may be made of metal such as aluminum or steel, and/or of a thermally insulative material such as many plastics.

Figure 23:
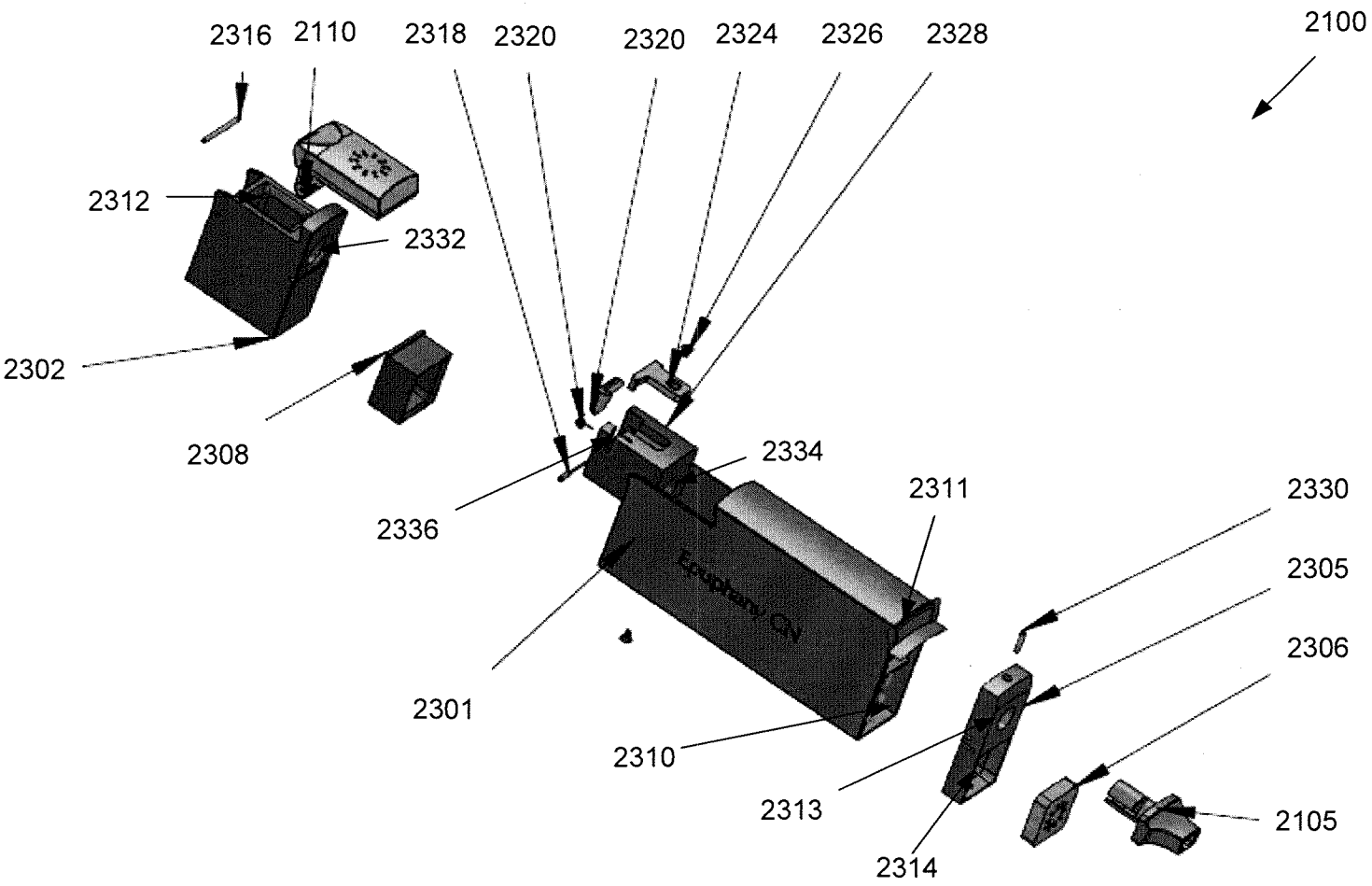
FIG. 23 is an exploded view of a smoke and odor elimination cigarette-smoking pipe, in accordance with an embodiment of the present invention.

FIG. 23 illustrates an exploded perspective view of a smoke and odor elimination cigarette-smoking pipe 2100, in accordance with an embodiment of the present invention. The pipe 2100 comprises a body 2301, a chamber housing 2302, a fitting 2305, a shutter 2320 and a shutter insert 2328, among other components.

The body 2301 has two channels, namely, a lower channel 2310 and an upper channel 2311. An end cap 2308 with a through-hole (not shown in FIG. 23) is positioned on the rear end of the lower channel 2310. The through hole may be configured to securely couple with the tip of the exhalation filter.

The chamber housing 2302, which may be made of a material such as aluminum, is positioned near the rear side of the body 2301. The chamber housing 2302 is coupled to the flip-top lid 2110 with an intake lid dowel pin 2316. The chamber housing 2302 forms an ignition chamber 2312 exposing a tip of a cigarette 2106 when the lid 2110 is open. The chamber housing 2302 includes a chamber opening 2332 to accept and support the tip of the cigarette 2106 in the ignition chamber 2312.

The fitting 2305 is positioned in the front end of the body 2301. The fitting 2305 includes two passageways, namely, an upper passageway 2313 that interfaces with the upper channel 2311 and a lower passageway 2314 that interfaces with the lower channel 2310. In some embodiments, the fitting 2305 is attached substantially airtight to the body 2310, e.g., using glue. The upper passageway 2313 is configured to accept the mouthpiece 2105 therein. The mouthpiece 2105 may be mounted with an O-ring (not shown in FIG. 22) to create an airtight seal between the mouthpiece 2105 and the fitting 2305. A mouthpiece pin 2330 may also help affix the mouthpiece 2105 to the fitting 2305. The lower passageway 2314 may be configured to receive an exhalation filter (not shown in FIG. 23) into the lower channel 2310. The lower passageway 2314 may also be configured to accept an exhalation vent cap 2306.

In some embodiments, the exhalation vent cap 2306 is removable to allow replacement of exhalation filter cartridges. In some embodiments, the exhalation vent cap 2306 is part of or integrated with the exhalation filter cartridge.

The pipe 2100 may include a shutter 2320 and a shutter insert 2328 within the upper channel 2311 of the body 2301. A shutter pivot clamp 2324, a fastener such as a screw 2326, and other connectors such as a shutter pin 2318 and a shutter spring 2320 may ensure that the shutter 2320 and the shutter insert 2328 are coupled to the upper channel 2311 and that the shutter 2320 and the shutter insert 2328 are biased to a closed position. The shutter insert 2328 may comprise an aperture 2334 which allows a cigarette to pass from the upper passageway 2313 through shutter chamber 2336 to the chamber opening 2332. When the cigarette 2106 is inserted, the shutter 2320 may be deflected to an open position. As described in detail below, the shutter 2320 assists in limiting airflow to the cigarette 2106 when the cigarette 2106 reaches a predetermined length, such as the length of a conventional cigarette filter.

FIGS. 24*a*-24*f* illustrate internal details of the smoke and odor elimination cigarette-smoking pipe 2100, in accordance with an embodiment of the present invention.

Figures 24A, 24B, 24C:
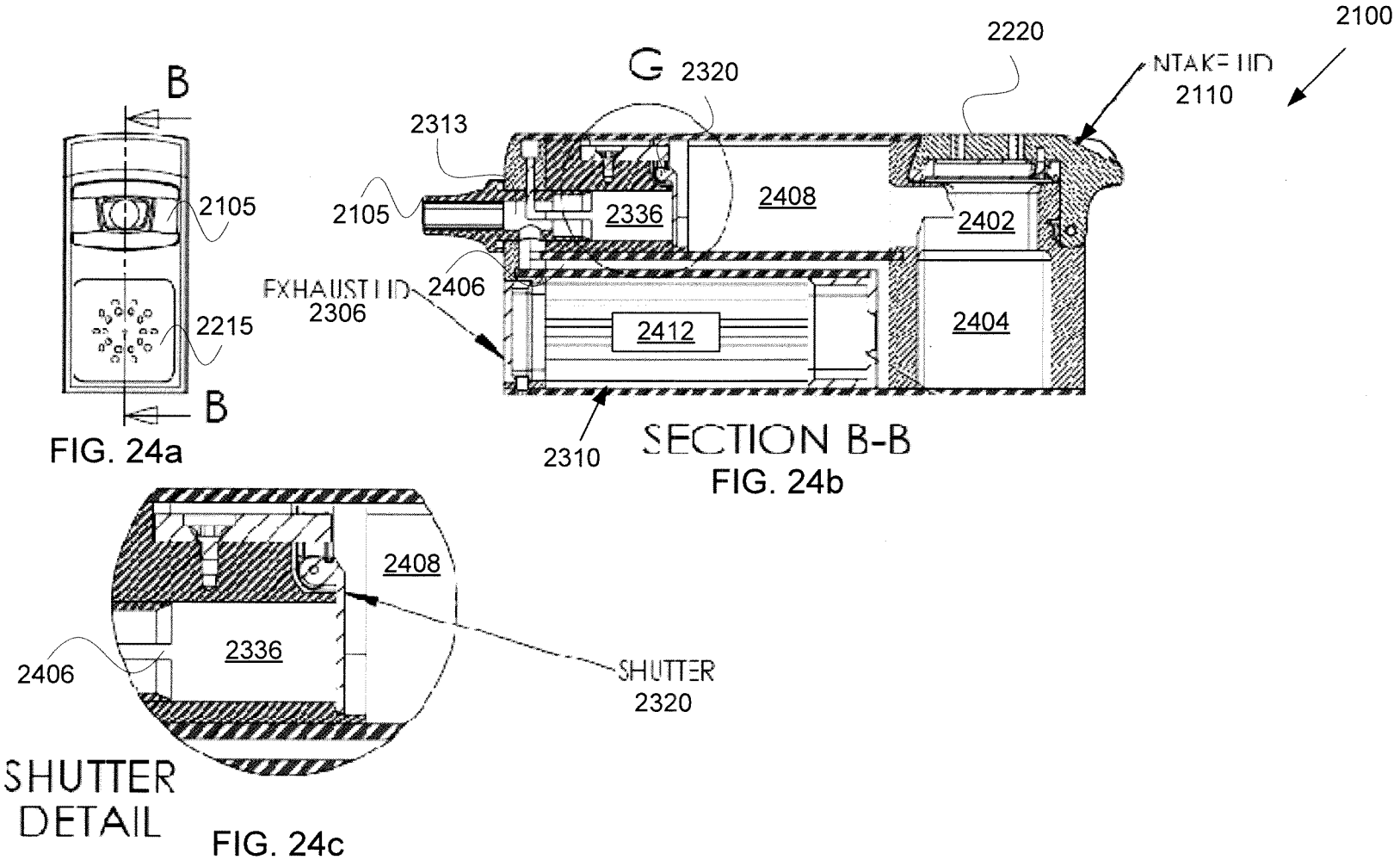
FIGS. 24*a*-24*f* illustrate the internal details of a smoke and odor elimination cigarette-smoking pipe, in accordance with an embodiment of the present invention.

FIG. 24*a* illustrates a front view of the pipe 2100, and identifies plane B-B half way between the left and right sides of the front face. FIG. 24*a* further illustrates the mouthpiece 2105 and the one-way exhalation vents 2215 residing on the front of the pipe 2100.

FIG. 24*b* illustrates a sectional view of the pipe 2100 at plane B-B. As shown in FIG. 24*b*, the pipe 2100 comprises an inhalation path configured to allows airflow from ignition chamber 2402 though combustion chamber 2408 and cigarette 2106 during inhalation. When the flip-top lid 2110 is closed, inhalation at the mouthpiece 2105 continues to allow airflow through the inhalation vents 2220. In this embodiment, the path from the inhalation vents 2220 through the cigarette 2106 to the mouthpiece 2105 may be referred to as an "inhalation path."

The pipe 2100 comprises an exhalation path configured to allow airflow through the exhalation filter 2412 during exhalation. For instance, smoke exhaled into the mouthpiece 2105 travels through a passage 2406 to the exhalation filter 2412, ultimately out the pipe 2100 through the exhalation vent cap 2306. During exhalation, a one-way inhalation valve (example shown in FIG. 3) in the flip-top lid assembly 2110 prevents airflow through the cigarette 2106. A one-way exhalation valve allows airflow into the lower channel 2310, through the exhalation filter 2412, and out the exhalation vent cap 2306. The one-way exhalation valve prevents airflow through the filter during inhalation. In some embodiments, the exhalation valve may be part of the filter 2412, in the exhalation vent cap 2306, and/or in other locations. In this embodiment, the path from the mouthpiece 2105 through the passage 2406 and the exhalation filter 2412 to the exhalation vent cap 2306 may be referred to as an "exhalation path."

FIG. 24*c* illustrates an expanded view of the shutter chamber 2336 in FIG. 24*b*. As shown, a shutter 2320 separates the shutter chamber 2336 from the combustion chamber 2408. The shutter 2320 may be positioned to substantially limit airflow through the inhalation path when the cigarette burns to a predetermined length. As stated above, when a cigarette 2106 is inserted into the combustion chamber 2408, the shutter 2320 is deflected to an open position. However, when the cigarette 2106 burns to become shorter than the distance separating the shutter 2320 from the mouthpiece 2105, an internal spring (not shown) causes the shutter 2320 to return to a closed position. In the closed position, the shutter 2320 restricts airflow through the inhalation path of the pipe 2100. In one embodiment, the shutter 2320 may be positioned to correspond to the filter length of the cigarette 2106.

Figure 24D:
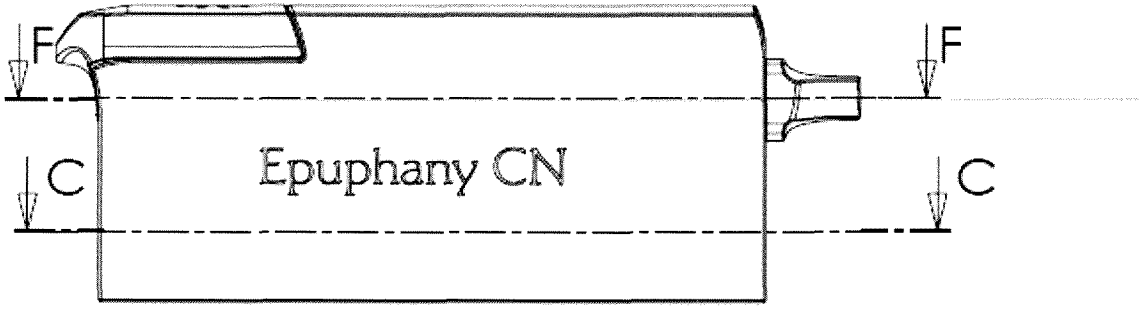

FIG. 24*d* illustrates a side view of the pipe 2100, in accordance with an embodiment of the present invention. FIG. 24*d* defines plane F-F as a section through the upper channel 2311 and defines plane C-C as a section through the lower channel 2310.

Figure 24E:
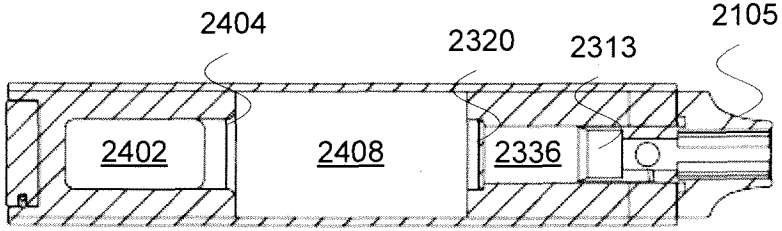

FIG. 24*e* illustrates sectional view of plane F-F through the pipe 2100. As shown, plane F-F may cut through the ignition chamber 2402, the combustion chamber 2408, the shutter 2320, the shutter chamber 2336, the upper passageway 2313, and the mouthpiece 2105.

Figure 24F:
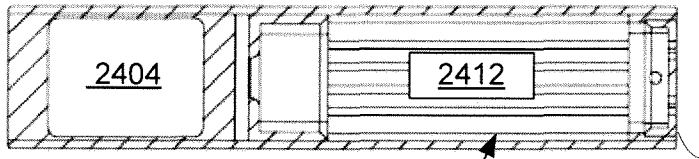

FIG. 24*f* illustrates a sectional view of plane C-C through the pipe 2100. As shown, plane C-C may cut through an ash chamber 2404, the lower channel 2310, the exhalation filter 2412, and the exhalation vent cap 2306.

FIGS. 25*a*-26*c* illustrate the internal details of an exhalation filter 2412, in accordance with an embodiment of the present invention.

Figure 25A:
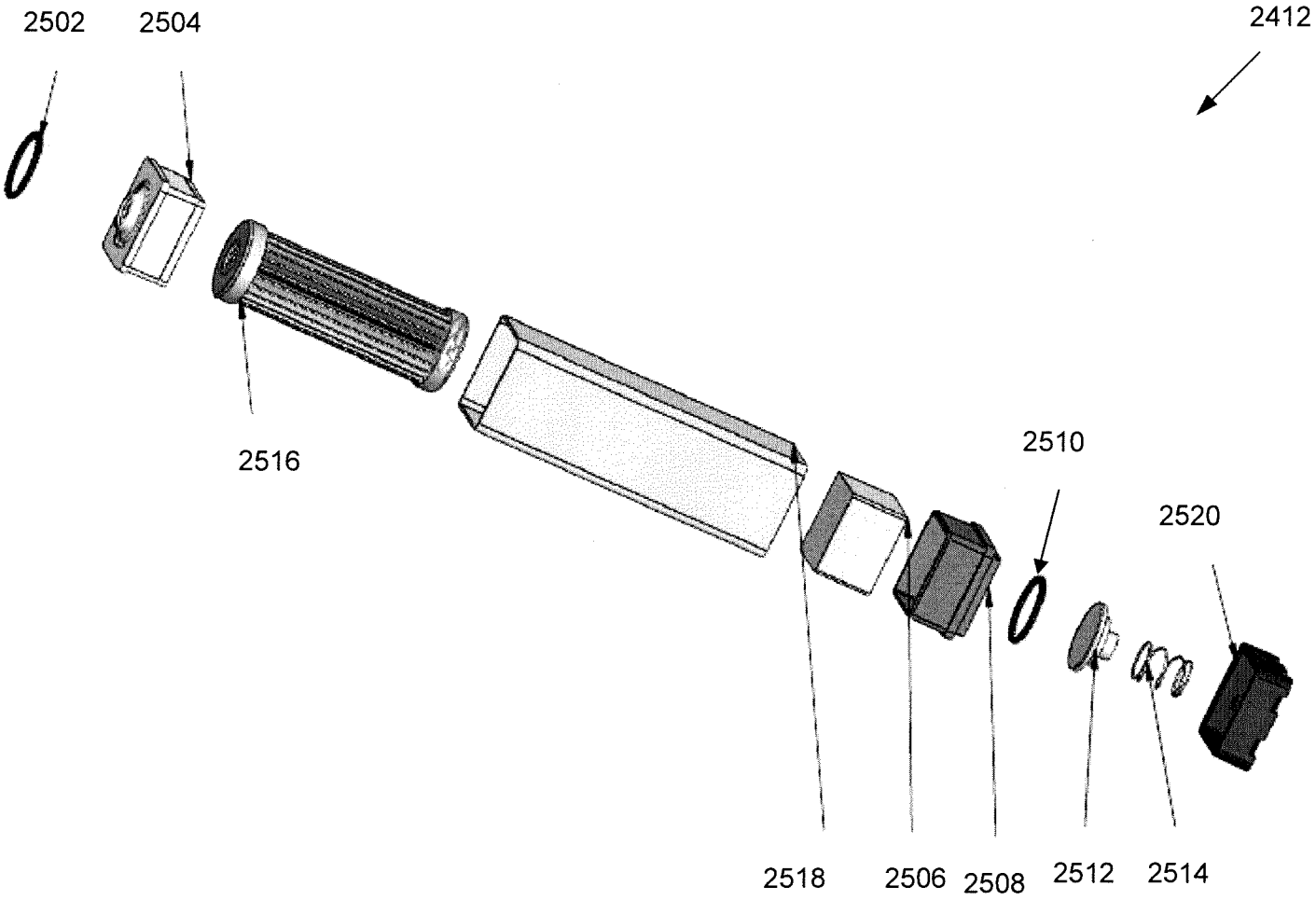

FIG. 25*a* illustrates an exploded view of an exhalation filter 2412, in accordance with an embodiment of the present invention. The exhalation filter 2412 comprises an O-ring 2502, an inlet cap 2504, a pleated cartridge 2516, a filter body 2518, a foam filter 2506, a filter body cap 2508, an internal O-ring 2510, a valve piston 2512, a piston spring 2514, and an end cap 2520.

The filter body 2518 houses the pleated cartridge 2516 and the foam filter 2506 between the inlet cap 2504 and the filter body cap 2508. In one embodiment, the pleated cartridge 2516 includes a HEPA filter. In one embodiment, the pleated cartridge 2516 is similar to the pleated HEPA filter 1624 depicted in FIGS. 17*a* and 17*b* above. A foam core is positioned within the pleated cartridge 2516. The foam core may be manufactured from core of 60 pours-per-inch (PPI) (the PPI can be higher or lower) polyether polyurethane foam (or other foam). The foam core may be infused with a odor capturing substance, e.g., odor absorbing materials such as Ecosorb® odor-absorbing products manufactured by OMI Industries. Citrus, mint, and/or cinnamon extracts (or other extracts) can additionally or alternatively be added to the oil to provide a selection of scents.

The filter body end cap 2508 is configured to enclose the foam filter 2506 and the pleated cartridge 2516 within the filter body 2518. The valve spring 2514 biases the valve piston 2512 and O-ring 2508 against the filter body cap 2508, thereby creating a one-way exhalation valve within the filter 2412.

Figure 25B:
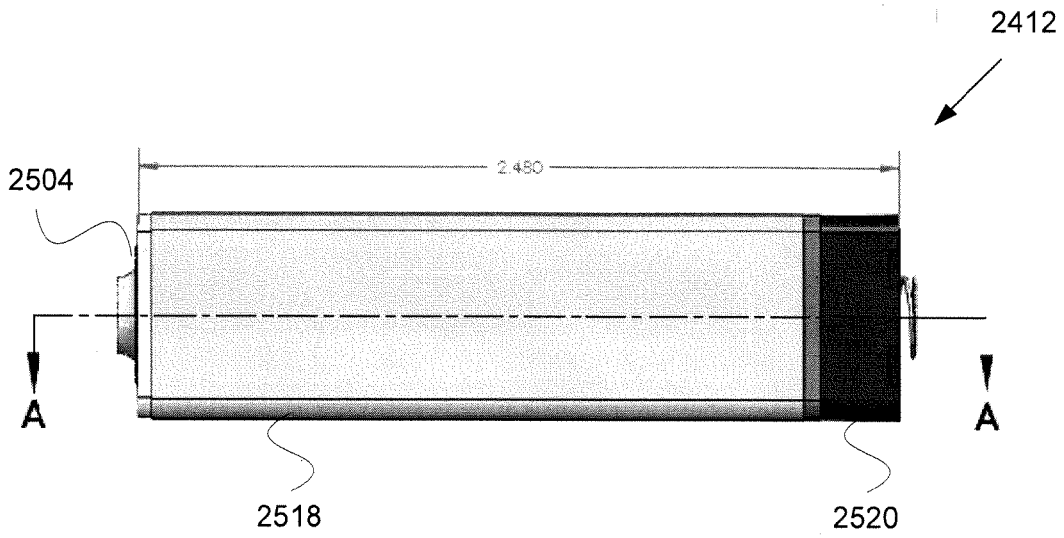

FIG. 25*b* illustrates a side view of the exhalation filter 2412. In one embodiment, the filter body 2518 has a length of 2.480 inches. FIG. 25*b* further defines plane A-A through the center of the filter 2500.

Figure 25C:
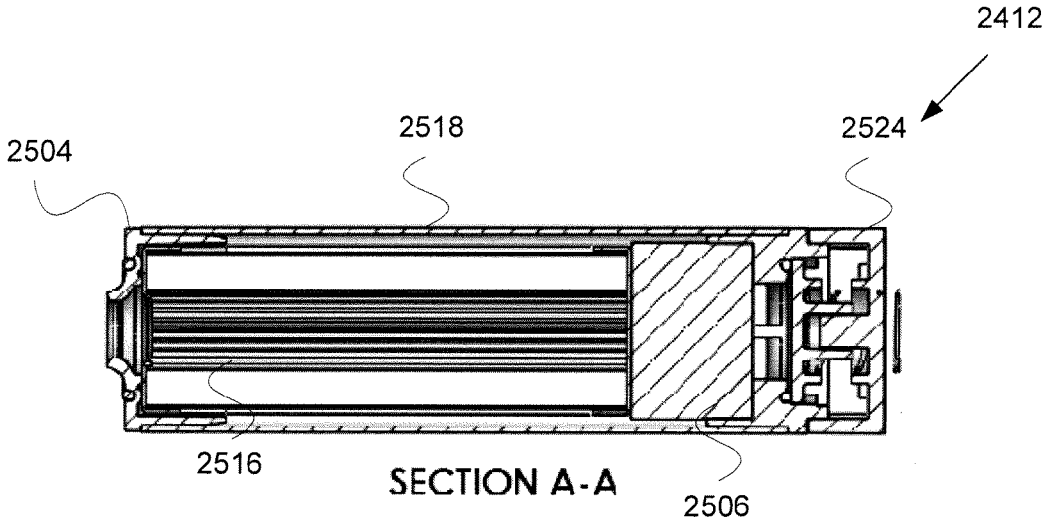

FIG. 25*c* illustrates a sectional view of plane A-A through the exhalation filter 2412. As shown, plane A-A traverses the inlet cap 2504, the filter body 2518, the pleated cartridge 2516, the foam filter 2506, and the end cap assembly 2524. The end cap assembly 2524 is shown as including the end cap 2520, the valve piston 2512 and the piston spring 2514 in a compressed state.

It will be appreciated that embodiments of the filter 2412 may use natural or synthetic fibers, ceramic, metal, chemicals, oils, and/or crystals for filtering.

Figures 26A, 26B, 26C:
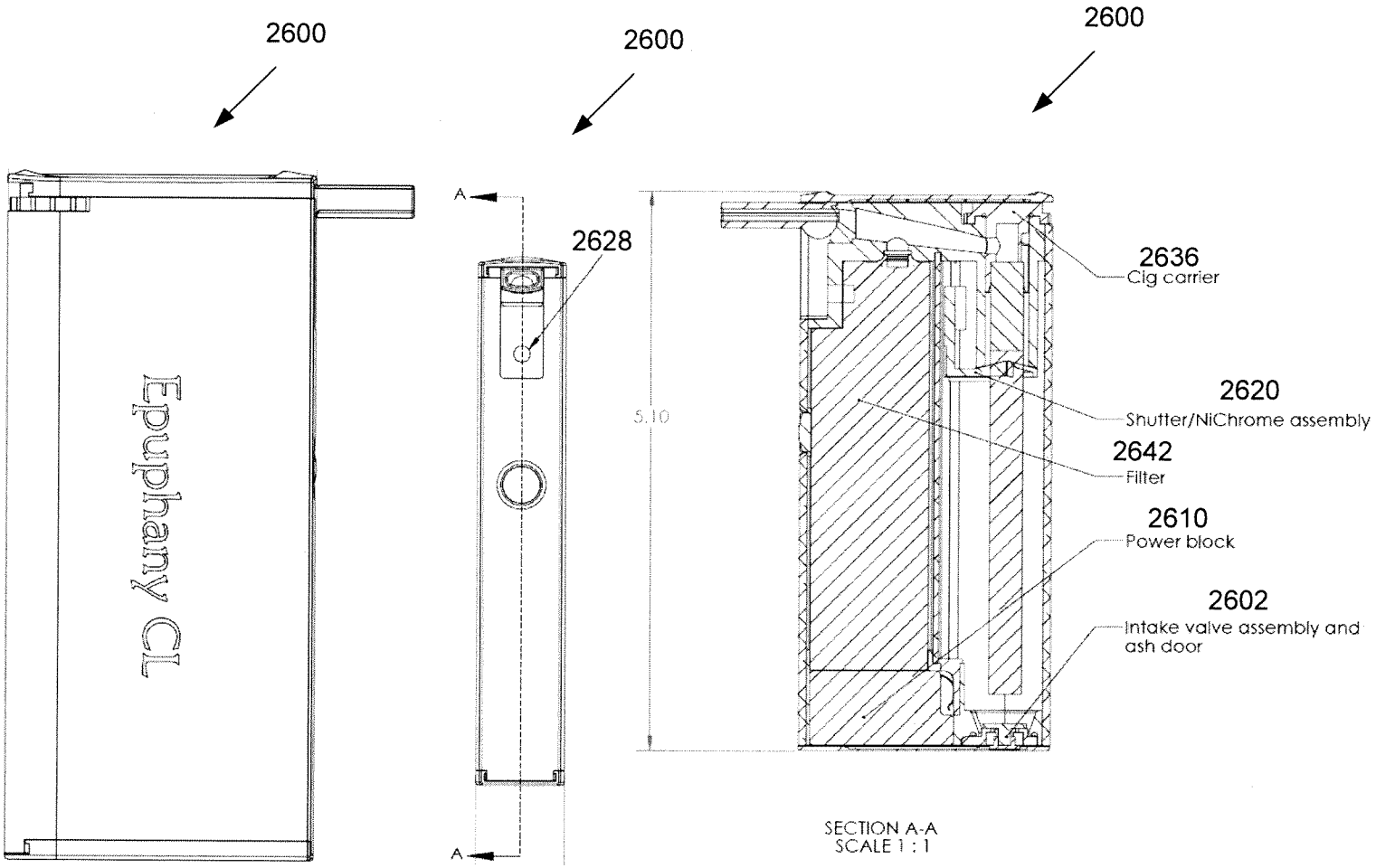

FIGS. 26*a*-26*c* illustrate a smoke and odor elimination cigarette-smoking pipe 2600, according to an embodiment of the present invention. FIG. 26*a* illustrates an external side view of the pipe 2600.

FIG. 26*b* illustrates a side view of the pipe 2600 and identifies plane A-A half way between the left and right sides of the front face. The pipe 2600 includes an exhaust port 2628 to channel exhaled smoke out of the pipe 2600.

FIG. 26*c* illustrates a sectional view of the pipe 2600 at the plane A-A. The pipe 2600 comprises an intake valve assembly (including one-way inhalation valve) and ash door 2602 (for emptying cigarette ash). The pipe 2600 further comprises a cap 2636 to receive a cigarette 2106. The pipe 2600 comprises an exhalation filter 2642 (which may be the same or similar to exhalation filter 2412) and a power block 2610. The power block 2610 is used to heat an electric heating element. The pipe 2600 also includes a shutter 2620 for preventing the smoking of the cigarette filter. Greater detail of the pipe 2600 is provided with reference to FIG. 27.

Figure 27:
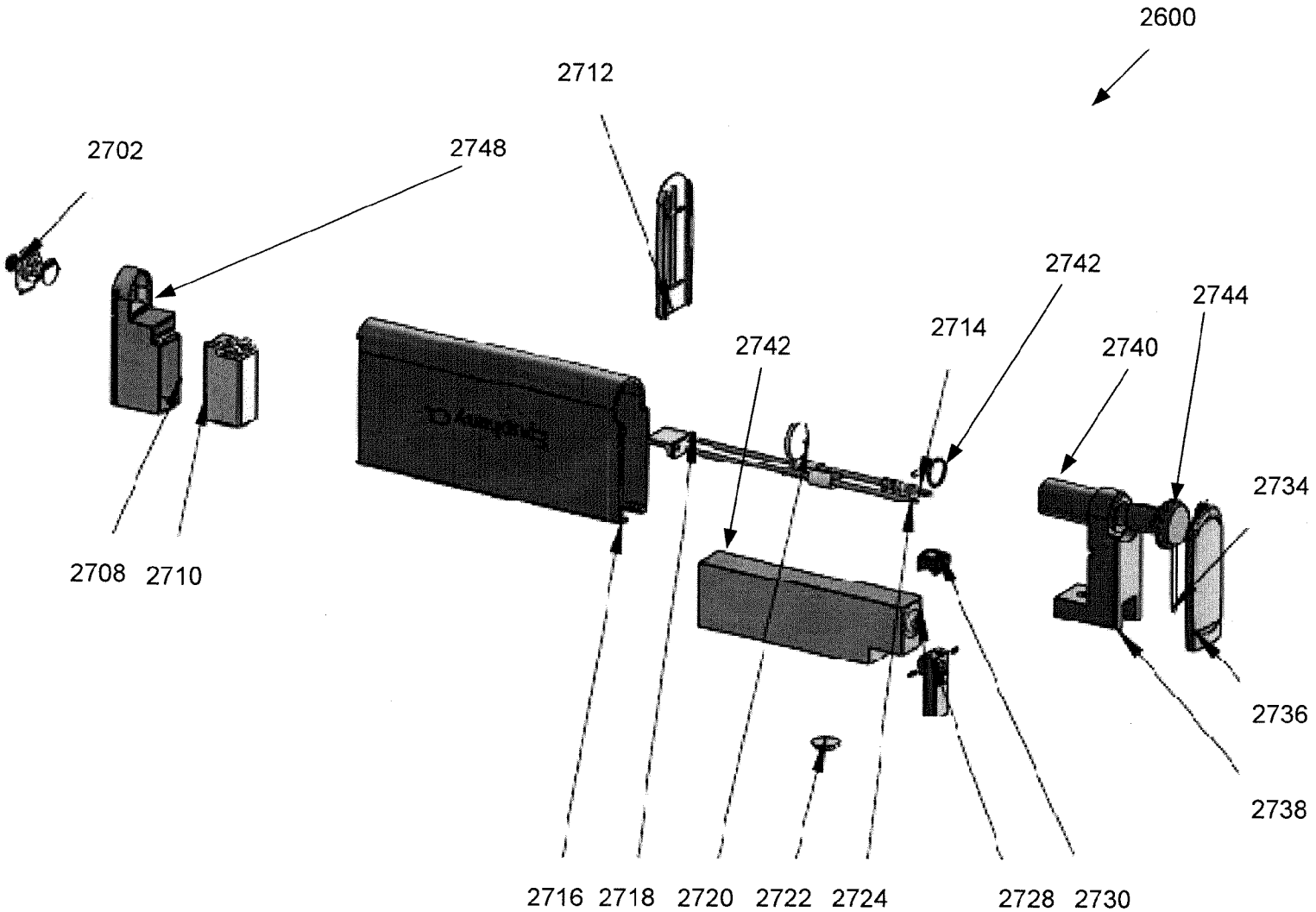
FIG. 27 illustrates an exploded view of a smoke and odor elimination cigarette-smoking pipe, in accordance with an embodiment of the present invention.

FIG. 27 illustrates a smoke and odor elimination cigarette-smoking pipe 2600, in accordance with an embodiment of the present invention. The pipe 2600 comprises an end block 2708, a body 2716, a head 2738, and a slidable cap 2736. The end block 2708 fits into the body 2716. A power block 2710 rests on the end block 2708 within the body 2716 for powering a resistive heating element (not shown) for igniting the cigarette 2106. Electrical posts 2724 are coupled to a contact block 2718, which in turn is coupled to the power block 2710. The electrical posts 2724 extend alongside the cigarette 2106 when inserted. The power block 2710 comprises a battery or other power source that supplies electrical energy to the resistive heating element. An ignition button 2722 interfaces with electrical circuitry (not shown) in the power block 2710 to power the resistive heating element and ignite the cigarette 2106.

The end block 2708 includes a receptacle 2748. An ash door and one-way inhalation valve assembly 2702 are positioned within the receptacle 2748 to capture cigarette ash and restrict airflow during exhalation.

A shutter 2720 is coupled to the electrical posts 2724. A spring 2714 biases the shutter 2720 in a closed position. The end block 2708, shutter 2720 and body 2716 form an ignition and combustion chamber. The shutter 2720 and the spring 2714 restrict airflow through the inhalation path when the cigarette 2106 reaches a predetermined length.

An O-ring 2742 seals a cigarette cylinder 2740 of the head 2738 to the body 2716. A cylinder cap 2744 opens to receive a cigarette 2106. A lever 2734 facilitate the loosening and tightening of the cylinder cap 2744. Thus, when a cigarette 2106 is inserted into the cigarette cylinder 2740, the cigarette 2106 deflects the shutter 2720 and is received into the ignition and combustion chamber.

The pipe 2600 comprises an inhalation path configured to allow airflow from the one-way valve assembly 2702 through the ignition and combustion chamber and the cigarette 2106 to the mouthpiece 2728 during inhalation. The mouthpiece may be coupled to the head 2738 and filter 2742 via a mouthpiece adapter 2730.

The pipe 2600 comprises an exhalation path configured to allow airflow through the exhalation filter 2726 during exhalation. Smoke exhaled into the mouthpiece 2734 is channeled through the filter 2742 out the exhaust port 2628. The exhalation filter 2742 may include a one-way exhalation valve to allow airflow during exhalation.

Figure 28:
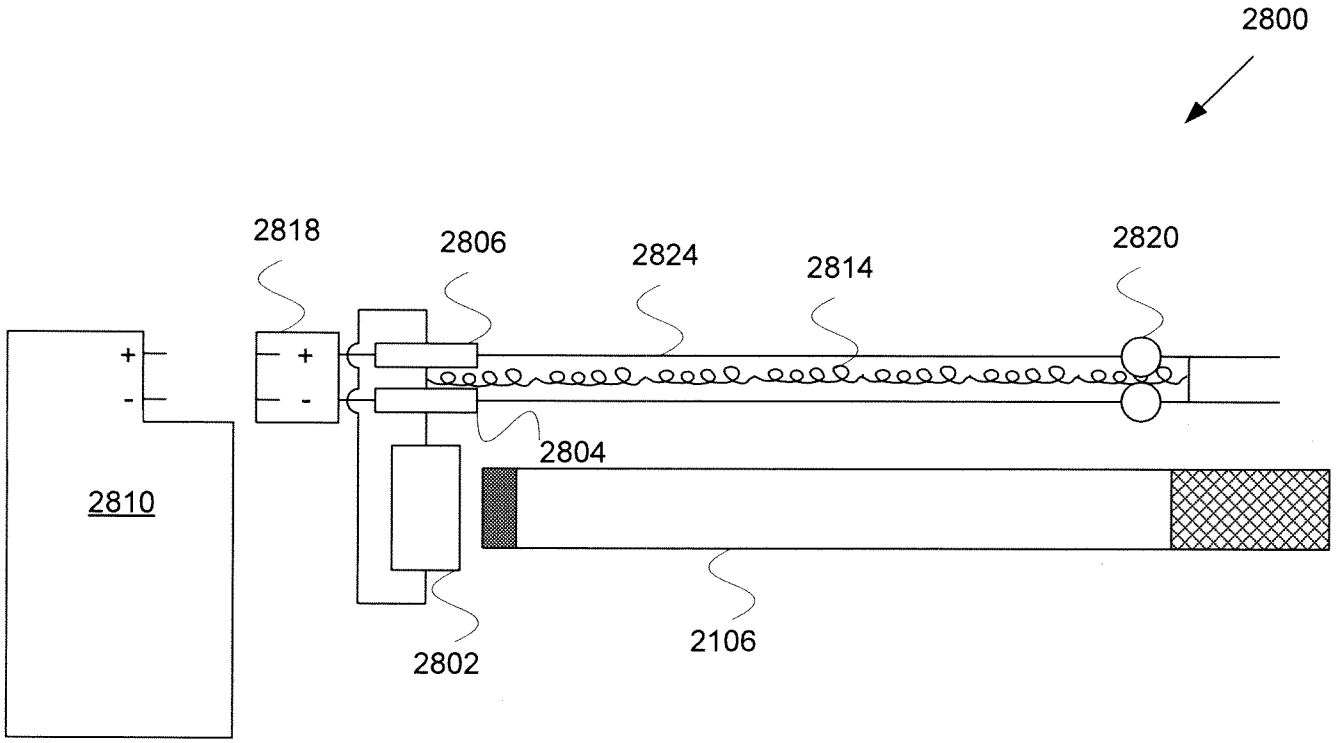
FIG. 28 illustrates a sliding contact structure, in accordance with an embodiment of the invention.

FIG. 28 illustrates a slidable heating element system 2800, in accordance with an embodiment of the invention. As shown, the slidable heating element system 2800 comprises electrical posts 2824 with a contact block 2818 coupled to a power source 2810. The slidable heating element system 2800 further comprises a resistive heating element 2802 biased to contact the tip of the cigarette 2106 using a spring 2814. The resistive heating element 2802 is coupled to the electrical posts 2824 via slidable cylinders 2804 and 2806, which provide electrical connection to the contact block 2818. The slidable heating element system 2800 further includes a stopping structure 2820 that prevents the resistive heating element 2802 from pursuing the tip of the cigarette 2106 after it reaches a predetermined length. The resistive heating element 2802 is capable of sliding between the end point of the post 2824 and the stopping structure 2820.

When the ignition button 2722 on the pipe 2700 is depressed, the power source 2810 electrically activates the contact block 2818 and causes the resistive heating element 2802 to heat and ignite the cigarette 2106. As the cigarette 2106 burns, the resistive heating element 2802 pursues the tip of the cigarette 2106. Upon reaching the stopping block 2820, the resistive heating element 2802 no longer contacts the tip of the cigarette 2106 causing the cigarette 2106 to go out naturally. The stopping block 2820 may be positioned to accommodate a predetermined length, such as the length of a cigarette filter.

Although several of the embodiments have been described as using the same mouthpiece for inhalation and exhalation, one skilled in the art will recognize that separate mouthpieces may be used. Several embodiments have been described as using a cigarette. However, one skilled in the art will recognize that the pipe may be used to receive other smoking devices such as cigars, thin cigarettes, hand-rolled cigarettes, joints, or the like. One skilled in the art will recognize that, in some embodiments, the inhalation path and exhalation path may not overlap. The term "pipe" herein shall include various types of smoking devices, including bongs, hookahs, e-cigarettes, or the like. It will be appreciated that the term "smoke" may or may not include odor and may or may not include visible smoke.

Embodiments of the present invention preserve the commonplace and enjoyable experience of smoking and reduce or eliminate the adverse effects of secondhand and thirdhand smoke. For instance, embodiments of the present invention reduce or eliminate the odors and particulate matter that get into hair, clothing, and other surfaces, related to thirdhand smoke. Further, embodiments of the present invention reduce or eliminate the amount of nicotine, THC, tar, smoke, particulate matter, and/or other chemicals that adversely affect the health of non-smokers who are near smokers. The health of non-smoking friends and family members is therefore beneficially enhanced. Embodiments of the present invention therefore allow smokers to enjoy the recreational, ritual, spiritual, medical, and other purposes of smoking without the environmental and health effects of secondhand and thirdhand smoke.

The foregoing description of the preferred embodiments of the present invention is by way of example only, and other variations and modifications of the above-described embodiments and methods are possible in light of the foregoing teaching. The embodiments described herein are not intended to be exhaustive or limiting. The present invention is limited only by the following claims.

The invention claimed is:

1. An enclosed smoking device, comprising:

a combustion chamber capable of receiving a cigarette, the combustion chamber being sized so that the cigarette is secured inside the combustion chamber when inserted therein;

an inhalation path for allowing inhalation airflow from the combustion chamber through the cigarette during inhalation by a user, the inhalation path comprising an inhalation vent for allowing the inhalation airflow into the combustion chamber, and the inhalation path further comprising a one-way inhalation valve allowing the inhalation airflow to travel only through the cigarette during inhalation;

an exhalation filter including a high efficiency particulate air (HEPA) filter and a foam core within the HEPA filter, the foam core having a longitudinal bore;

an odor absorbing fluid infused in at least a portion of the exhalation filter;

an exhalation path for forcing exhalation airflow through the longitudinal bore and then through the foam core and then through the HEPA filter, and for forcing the exhalation airflow into contact with the odor absorbing fluid during exhalation by the user, the exhalation path including a one-way exhalation valve for preventing the exhalation airflow from traveling through the cigarette and for allowing the exhalation airflow to travel through the exhalation filter during exhalation;

a heating element in contact with a tip of the cigarette, the heating element being biased to contact the tip of the cigarette as the cigarette combusts and until the cigarette reaches a predetermined length; and an ash chamber coupled to the combustion chamber and having an ash outlet adapted to facilitate removal of a combusted portion of the cigarette generated as the cigarette combusts, the ash outlet being distinct from the inhalation vent.

2. The enclosed smoking device of claim 1, further comprising a mouthpiece coupled to the inhalation path and the exhalation path.

3. The enclosed smoking device of claim 1, further comprising a lid located over the combustion chamber, the lid allowing a flame to reach the tip of the cigarette when opened and creating a substantially airtight inhalation seal with the combustion chamber when closed.

4. The enclosed smoking device of claim 1, further comprising a shutter configured to restrict the inhalation airflow through the cigarette during inhalation after the cigarette reaches a predetermined length.

5. The enclosed smoking device of claim 1, further comprising a contact block configured to limit the heating element from continuing to contact the tip of the cigarette after the cigarette reaches a predetermined length.

6. The enclosed smoking device of claim 1, wherein the foam core includes odor absorbing chemicals for removing odor from exhaled smoke.

* * * * *